US011839780B1

(12) United States Patent
Singal et al.

(10) Patent No.: US 11,839,780 B1
(45) Date of Patent: Dec. 12, 2023

(54) AIR PURIFIER AND METHOD

(71) Applicants: Krishan Kumar Singal, Severna Park, MD (US); Gaurav Singal, Newton, MA (US)

(72) Inventors: Krishan Kumar Singal, Severna Park, MD (US); Gaurav Singal, Newton, MA (US)

( * ) Notice: Subject to any disclaimer, the term of this patent is extended or adjusted under 35 U.S.C. 154(b) by 0 days.

(21) Appl. No.: 18/202,248

(22) Filed: May 25, 2023

(51) Int. Cl.
*A62B 7/10* (2006.01)
*A62B 9/02* (2006.01)
*A62B 18/02* (2006.01)

(52) U.S. Cl.
CPC ..... *A62B 7/10* (2013.01); *A62B 9/02* (2013.01); *A62B 18/02* (2013.01)

(58) Field of Classification Search
CPC .. A62B 7/10; A62B 9/02; A62B 23/02; A62B 18/02; A61M 16/105; A61M 16/107
See application file for complete search history.

(56) References Cited

U.S. PATENT DOCUMENTS

| | | | | |
|---|---|---|---|---|
| 3,390,676 | A * | 7/1968 | Warncke | A62B 7/10 128/204.28 |
| 5,165,395 | A | 11/1992 | Ricci | |
| 5,902,365 | A * | 5/1999 | Haggard | B01D 46/2411 55/498 |
| 6,595,207 | B1 | 7/2003 | McDonald et al. | |
| 6,691,706 | B2 | 2/2004 | Ives | |
| 7,523,750 | B2 | 4/2009 | Krzysztofik | |
| 7,658,891 | B1 | 2/2010 | Barnes | |
| 8,733,356 | B1 | 5/2014 | Roth | |
| 8,960,190 | B2 | 2/2015 | James et al. | |
| 9,724,545 | B2 | 8/2017 | Augustine et al. | |
| 10,029,797 | B2 | 7/2018 | Space et al. | |
| 11,191,864 | B1 * | 12/2021 | Singal | A61M 16/0683 |
| 2008/0232092 | A1 | 9/2008 | Carter | |
| 2009/0004047 | A1 * | 1/2009 | Hunter | A61L 9/205 422/4 |
| 2009/0205664 | A1 | 8/2009 | Lyon | |
| 2010/0037891 | A1 * | 2/2010 | Walker | A62B 7/12 128/201.23 |
| 2012/0138059 | A1 * | 6/2012 | Teetzel | A62B 7/02 128/205.12 |

(Continued)

FOREIGN PATENT DOCUMENTS

| | | | |
|---|---|---|---|
| AU | 2020100503 | A4 | 5/2020 |
| CN | 111053984 | A | 4/2020 |

(Continued)

*Primary Examiner* — Victoria Murphy
(74) *Attorney, Agent, or Firm* — Rahman LLC

(57) ABSTRACT

A portable air purifier and method includes a collapsible first tube; a perforated firm second tube that houses the first tube; a fan that brings air into a first end of the first tube and pushes the air through the first tube; a multi-part filter arranged in a concentric configuration inside the first tube; an outlet at a second end of the first tube; and a breathing mask coupled to the outlet. The filter filters the air as the air proceeds through the first tube and the outlet discharges filtered air from the first tube to the breathing mask. The first tube and the second tube may be semi-circular to fit around the neck of a user. The filter may be a corrugated filter. The portable air purifier may include a power source electrically connected to the fan.

18 Claims, 18 Drawing Sheets

(56) References Cited

U.S. PATENT DOCUMENTS

| | | | | |
|---|---|---|---|---|
| 2012/0174922 | A1* | 7/2012 | Virr | A61M 16/106 128/206.28 |
| 2012/0199003 | A1 | 8/2012 | Melikov et al. | |
| 2012/0279503 | A1 | 11/2012 | Zhou et al. | |
| 2014/0363333 | A1 | 12/2014 | Carr | |
| 2014/0373846 | A1* | 12/2014 | Kao | A62B 18/006 128/205.12 |
| 2016/0121145 | A1 | 5/2016 | Hopermann et al. | |
| 2017/0189727 | A1* | 7/2017 | Hunter | A62B 18/006 |
| 2018/0001049 | A1* | 1/2018 | Schuller | B01D 53/0415 |
| 2018/0001120 | A1* | 1/2018 | Virr | A62B 18/025 |
| 2018/0214585 | A1 | 8/2018 | Piper | |
| 2018/0296864 | A1* | 10/2018 | Feasey | A62B 18/003 |
| 2019/0009115 | A1* | 1/2019 | Zhong | A62B 18/08 |
| 2019/0134434 | A1* | 5/2019 | Schuller | A62B 9/006 |
| 2019/0275357 | A1* | 9/2019 | Palmer, Jr. | A61B 5/746 |
| 2020/0376305 | A1* | 12/2020 | Lang | A62B 7/10 |
| 2021/0275714 | A1* | 9/2021 | Almeida | A62B 18/025 |

FOREIGN PATENT DOCUMENTS

| | | | |
|---|---|---|---|
| DE | 202020101798 | U1 | 4/2020 |
| JP | 2007202826 | A | 8/2007 |
| KR | 10-2019-0138151 | A | 12/2019 |
| KR | 10-2020-0020747 | A | 2/2020 |
| KR | 20210094215 | A | 7/2021 |
| NO | 20200374 | A1 | 4/2020 |
| WO | 2006026517 | A2 | 3/2006 |
| WO | 2021195115 | A1 | 9/2021 |

* cited by examiner

FIG. 8

| Trial | Run | Organism | Target Monodispersed Particle Size | Trial Time | System Flow Rate | Sampling Locations | Sampling |
|---|---|---|---|---|---|---|---|
| Single Pass No UV T1 | Challenge | MS2 Bacteriophage – RNA Virus | 0.8-1.0 μm | 5 min | 10lpm | Upstream and Downstream | Midget Impingers |
| Single Pass No UV T2 | Challenge | MS2 Bacteriophage – RNA Virus | 0.8-1.0 μm | 5 min | 10lpm | Upstream and Downstream | Midget Impingers |
| Single Pass No UV T3 | Challenge | MS2 Bacteriophage – RNA Virus | 0.8-1.0 μm | 5 min | 10lpm | Upstream and Downstream | Midget Impingers |
| Single Pass With UV T1 | Challenge | MS2 Bacteriophage – RNA Virus | 0.8-1.0 μm | 5 min | 10lpm | Upstream and Downstream | Midget Impingers |
| Single Pass With UV T2 | Challenge | MS2 Bacteriophage – RNA Virus | 0.8-1.0 μm | 5 min | 10lpm | Upstream and Downstream | Midget Impingers |
| Single Pass With UV T3 | Challenge | MS2 Bacteriophage – RNA Virus | 0.8-1.0 μm | 5 min | 10lpm | Upstream and Downstream | Midget Impingers |
| Chamber Test No UV T1 | Challenge | MS2 Bacteriophage – RNA Virus | 0.8-1.0 μm | 5 min | No added airflow | Upstream and Downstream | Midget Impingers |
| Chamber Test No UV T2 | Challenge | MS2 Bacteriophage – RNA Virus | 0.8-1.0 μm | 5 min | No added airflow | Upstream and Downstream | Midget Impingers |
| Chamber Test No UV T3 | Challenge | MS2 Bacteriophage – RNA Virus | 0.8-1.0 μm | 5 min | No added airflow | Upstream and Downstream | Midget Impingers |
| Chamber Test With UV T1 | Challenge | MS2 Bacteriophage – RNA Virus | 0.8-1.0 μm | 5 min | No added airflow | Upstream and Downstream | Midget Impingers |
| Chamber Test With UV T2 | Challenge | MS2 Bacteriophage – RNA Virus | 0.8-1.0 μm | 5 min | No added airflow | Upstream and Downstream | Midget Impingers |
| Chamber Test With UV T3 | Challenge | MS2 Bacteriophage – RNA Virus | 0.8-1.0 μm | 5 min | No added airflow | Upstream and Downstream | Midget Impingers |

FIG. 16

| Trial # | Upstream Conc. (pfu/l of air) | Downstream Conc. (pfu/l of air) | Percent Remaining | Percent Reduction | LOG Reduction |
|---|---|---|---|---|---|
| Single Pass No UV T1 | 9.09E+04 | 6.06E-01 | 0.001% | 99.9993% | -5.18 |
| Single Pass No UV T2 | 1.09E+05 | 1.21E+00 | 0.001% | 99.9989% | -4.95 |
| Single Pass No UV T3 | 4.85E+04 | 9.09E-01 | 0.002% | 99.9981% | -4.73 |
| Single Pass No UV Avg. | 8.28E+04 | 9.09E-01 | 0.001% | 99.9988% | -4.95 |
| Std. Deviation | 3.11E+04 | 3.03E-01 | 0.001% | 0.0006% | 0.22 |
| Single Pass With UV T1 | 2.32E+04 | 6.06E-01 | 0.003% | 99.9974% | -4.58 |
| Single Pass With UV T2 | 2.65E+04 | 6.06E-01 | 0.002% | 99.9977% | -4.64 |
| Single Pass With UV T3 | 2.80E+05 | 1.82E+00 | 0.001% | 99.9994% | -5.19 |
| Single Pass With UV Avg. | 1.10E+05 | 1.01E+00 | 0.002% | 99.9982% | -4.80 |
| Std. Deviation | 1.47E+05 | 7.00E-01 | 0.001% | 0.0011% | 0.33 |
| Chamber Test No UV T1 | 5.15E+03 | 3.03E-01 | 0.006% | 99.9941% | -4.23 |
| Chamber Test No UV T2 | 2.12E+03 | 3.03E-01 | 0.014% | 99.9857% | -3.85 |
| Chamber Test No UV T3 | 3.64E+03 | 3.03E-01 | 0.008% | 99.9917% | -4.08 |
| Chamber Test No UV Avg. | 3.64E+03 | 3.03E-01 | 0.010% | 99.9905% | -4.05 |
| Std. Deviation | 1.52E+03 | 0.00E+00 | 0.006% | 0.0059% | 0.19 |
| Chamber Test With UV T1 | 4.70E+03 | 3.03E-01 | 0.006% | 99.9935% | -4.19 |
| Chamber Test With UV T2 | 4.39E+03 | 3.03E-01 | 0.007% | 99.9931% | -4.16 |
| Chamber Test With UV T3 | 5.45E+03 | 9.09E-01 | 0.017% | 99.9833% | -3.78 |
| Chamber Test With UV Avg. | 4.85E+03 | 5.05E-01 | 0.010% | 99.9900% | -4.04 |
| Std. Deviation | 5.46E+02 | 3.50E-01 | 0.000% | 0.000% | 0.23 |

AIR PURIFIER AND METHOD

BACKGROUND

Technical Field

The embodiments herein generally relate to air purifiers and breathable masks. More particularly, the embodiments herein relate to a compact, efficient, and easily operable self-contained device to provide a personal, portable, and continuous supply of sterilized/purified breathable air.

Description of the Related Art

This background description includes information that may be useful in understanding the general scope of the present disclosure. It is not an admission that any of the information provided herein is prior art or relevant to the presently claimed invention, or that any publication specifically or implicitly referenced is prior art.

An infection is caused by the invasion of the body by an organism such as a bacteria, virus, or parasite, etc. Such pathogens may be transmitted by several routes such as an insect bite (e.g., malaria), animal bite (e.g., rabies), contact with other people (e.g., leprosy), contact with bodily fluids (e.g., HIV), eating contaminated food (e.g., typhoid), drinking impure water (e.g., giardiasis), and breathing contaminated air (e.g., common cold, influenza), among others.

The prevention of infection generally begins by avoiding contact with the infectious agent. Most people can understand how best to try to avoid being bitten by mosquitos, going near rabid animals, drinking unpurified water, etc. However, avoiding breathing contaminated air becomes challenging if one wishes to live a normal life and interact with society. Humans generally cannot hold their breath longer than a few minutes at a time. Moreover, humans typically breathe about 300 liters of air every hour. Accordingly, it is difficult to routinely carry bottled air for several hours (as opposed to food in a bag or water in a bottle, for example). Further, absent specialized equipment, humans typically cannot easily determine when the surrounding air is contaminated with these pathogens. Indeed, the difficulty of preventing airborne virus infections is highlighted by the coronavirus 2 (SARS-CoV-2) pandemic.

Attempts are being made to purify the air in contained environments such as by using air purifiers, disinfectants, and filtration, etc. However, such techniques tend to limit the mobility of people. Moreover, to avoid breathing contaminated air, people attempt to use masks to help filter out viruses with limited success. Sunlight can prevent the growth of micro-organisms. Moreover, the most effective bactericidal wavelengths are between 250 to 280 nanometers. The mechanism of injury to the microorganism is through the effect of UV-C on DNA/RNA rather than proteins. When an infected person coughs or sneezes, droplets containing infectious organisms are projected into the air as aerosols. These droplets quickly dry by evaporation and leave behind nuclei that can remain suspended in the air for a long time. Inhalation of such contaminated air can result in an infection to humans and animals. Tuberculosis is easily spread by a droplet of infectious organisms and exposing the contaminated air to ultraviolet light can prevent the spread of infection.

When Covid started, air travel grounded to a halt because of airborne virus spread. Masks with high filtration such as N95 were recommended. They quickly fell out of favor because of the difficulty in breathing when they were worn properly. In addition, the actual protection afforded was much less than 95%, partly due to leaks caused by negative pressure generated to suck air through the mask. Additionally, masks offer uncomfortable amount of resistance to flow of air. Moreover, leaks around the face mask decrease mask efficacy due to unfiltered air being sucked in.

Ultraviolet light may be used for Upper Room Air disinfection, water disinfection, and for air disinfection in HVAC systems. Ultraviolet may be used for destroying germs and may be produced by low-pressure mercury lamps. However, these devices tend to be cumbersome, use a lot of power, and produce ozone as a byproduct. Ultraviolet light is classified as UV-A, UV-B, and UV-C depending on the wavelength with UV-C being the shortest of the three. Though present in sunlight, UV-C is almost completely blocked in the Earth's upper atmosphere. Only UV-A and UV-B reach the Earth's surface in significant quantities. UV-C has very little depth of penetration and is absorbed by the outer dead layer of skin in humans. However, erythema and photokeratitis can occur upon overexposure to UV-C.

Some conventional solutions, such as those described in the cited references below, have been utilized to supply air and/or to provide air purification. The complete disclosures of all these references are incorporated by reference herein for the purposes of providing the scope of the conventional solutions, and not for limitation purposes. However, while these solutions may have been suitable for their specific applications, they contain some shortcomings that have not been overcome in the industry.

U.S. Patent Application Publication No. 2009/0004047 published to Hunter et al. on Jan. 1, 2009 utilizes a fan to blow air in a sterilization chamber and utilizes the blower pressure magnification with UV lenses to supply the air. However, fans tend to have large power requirements, thus making the apparatus unsuitable for convenient portability purposes and applications. U.S. Patent Application Publication No. 2009/0205664 published to Lyon on Aug. 20, 2009 utilizes a sterilization system containing UVC bulbs, ozone gas, and a fan to circulate the air. Ozone gas must be removed by the system prior to inhalation by a user due to its toxicity. This, in conjunction with the use of fans, requires a significant amount of power to ensure proper functioning of the system, which reduces the efficiency of the system and reduces the ease of portability. U.S. Pat. No. 7,658,891 issued to Barnes on Feb. 9, 2010 utilizes mercury vapor with UVC light and ozone gas to sterilize a hazmat suit, helmet, and mask. However, this apparatus is not used for providing inhaled sterilized air, but rather is used to sterilize equipment. Furthermore, the use of ozone gas in this apparatus means that it generally cannot be used for providing inhaled air due to the toxicity of ozone. Moreover, this apparatus is large and bulky utilizing a fan, which necessitates high power requirements and reduces the ease of portability for users. U.S. Patent Application Publication No. 2016/0121145 published to Hopermann et al. on May 5, 2016 provides a maintenance device to maintain a breathing apparatus. This device is often used with conventional breathing systems to remove toxic chemicals such as ozone that may build up in the system but is not generally used as a portable device for users.

Accordingly, there is, therefore, a need for a new highly portable technique for providing purified air for breathing purposes, which does not rely on the use of toxic ozone gas or requires the need for specialized maintenance equipment to decontaminate the system after use.

SUMMARY

In view of the foregoing, an embodiment herein provides a portable air purifier comprising a collapsible first tube; a firm second tube that houses the first tube, wherein the second tube comprises perforations; a fan that brings air into a first end of the first tube and pushes the air through the first tube; a multi-part filter arranged in a concentric configuration inside the first tube, wherein the multi-part filter is to filter the air as the air proceeds through the first tube; an outlet at a second end of the first tube, wherein the outlet is to discharge filtered air from the first tube; and a breathing mask coupled to the outlet to receive the filtered air. The first tube and the second tube may be semi-circular to fit around a neck of a user. The filter may be a corrugated filter. The portable air purifier may comprise a power source electrically connected to the fan, wherein the power source is to power the fan. The breathing mask may comprise a first valve to discharge exhaled air of a user; and a second valve to prevent filtered air from returning to the first tube. The first valve and the second valve may comprise one-way valves. The first tube may comprise a UVC light that sterilizes the air brought into the first tube. The first tube may comprise a UVC light that sterilizes the filter. The perforations may be sized to allow atmospheric pressure to transfer to the first tube. The filter may extend through a portion of the first tube. The filter may extend through approximately one-quarter of the length of the first tube. The filter may comprise a two-part filter.

Another embodiment provides a method for filtering air, the method comprising providing an air purifier comprising a collapsible first tube; a perforated firm second tube that houses the first tube; a fan adjacent to a first end of the first tube; a multi-part filter arranged in a concentric configuration inside the first tube; an outlet at a second end of the first tube; and a breathing mask coupled to the outlet; pushing air via the fan into the first tube; filtering the air via the filter as the air proceeds through the first tube; discharging filtered air through the outlet; and transmitting the filtered air into a breathing mask.

The method may further comprise arranging the air purifier around the neck of a user; and fitting the breathing mask over a mouth and nose of the user. The breathing mask may comprise a first valve and a second valve, and the method may further comprise discharging exhaled air through the first valve. The method may further comprise preventing, via the second valve, filtered air that enters the breathing mask from returning back to the first tube and preventing exhaled air from reverse flowing into the first tube. The method may further comprise sterilizing the air brought into the first tube with a UVC light. The method may further comprise sterilizing the filter with a UVC light. The method may further comprise sizing perforations of the second tube to allow atmospheric pressure to transfer to the first tube. The method may further comprise automatically adjusting the speed of the fan based on an action of a user. The speed may increase with inhalation of the filtered air, and the speed may decrease with exhalation of the filtered air.

A portable device is provided that can be carried by a user such that the device provides a continuous supply of sterilized air to allow the user to move about freely while breathing purified air, even in contaminated ambient surroundings. The embodiments herein provide a portable device to provide a personal, portable, and continuous supply of sterilized/purified breathable air. The portable device may assist in allowing a user to breathe purified air when the ambient air proves to be dangerous; e.g., when the ambient air is contaminated with unhealthy pollutants and/or infectious agents such as in mass transit vehicles (e.g., buses, trains, airplanes, etc.) at the time of epidemics/pandemics or in facilities such as schools, hospitals, clinics, nursing homes, etc., and to protect people in the event of bio-terrorism or soldiers and first responders in biological warfare scenarios.

The device can be configured to be of any suitable size, shape, and configuration and can be constructed using any suitable material, the number and power capacity of components such as LEDs, and power source(s), etc. may also be suitably selected. Furthermore, the breathing mask can be individualized for better user fit. Since the LEDs provide the pathogen destroying UVC and the system does not produce ozone gas, there is no need for specialized equipment for the removal of the ozone gas or specialized maintenance equipment. Accordingly, the device is always ready for portable use without undergoing maintenance for decontamination or requiring heavy peripheral equipment for proper functioning.

These and other aspects of the embodiments herein will be better appreciated and understood when considered in conjunction with the following description and the accompanying drawings. It should be understood, however, that the following descriptions, while indicating exemplary embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which:

FIG. 8 is a table illustrating the bioaerosol test matrix of the experiment according to the embodiments herein;

FIG. 16 is a table listing the results summary of the experimental testing of the air purifier according to the embodiments herein.

DETAILED DESCRIPTION

Figure 2A:
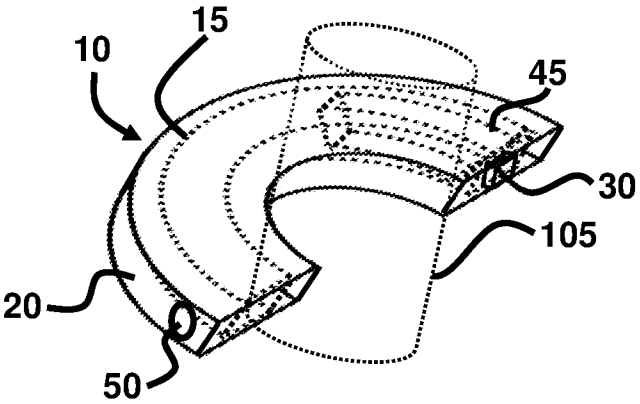
FIG. 2A is a schematic perspective diagram illustrating an air purifier according to the embodiments herein.

The embodiments herein and the various features and advantageous details thereof are explained more fully with reference to the non-limiting embodiments that are illustrated in the accompanying drawings and detailed in the following description. Descriptions of well-known components are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Various terms are used herein. To the extent a term used in a claim is not defined below, it should be given the broadest definition persons in the pertinent art have given that term as reflected in printed publications and issued patents at the time of filing.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all groups used in the appended claims.

In the specification, reference may be made to the spatial relationships between various components and to the spatial orientation of various aspects of components as the devices are depicted in the attached drawings. However, as will be recognized by those skilled in the art after a complete reading of the present application, the devices, members, components, etc. described herein may be positioned in any desired orientation. Thus, the use of terms such as "above," "below," "upper," "lower," "first", "second" or other like terms to describe a spatial relationship between various components or to describe the spatial orientation of aspects of such components should be understood to describe a relative relationship between the components or a spatial orientation of aspects of such components, respectively, as the device described herein may be oriented in any desired direction. Referring now to the drawings, and more particularly to FIGS. 1 through 16, where similar reference characters denote corresponding features consistently throughout the figures, there are shown examples of the embodiments herein. In the drawings, the size and relative sizes of components, layers, and regions, etc. may be exaggerated for clarity.

Figure 1:
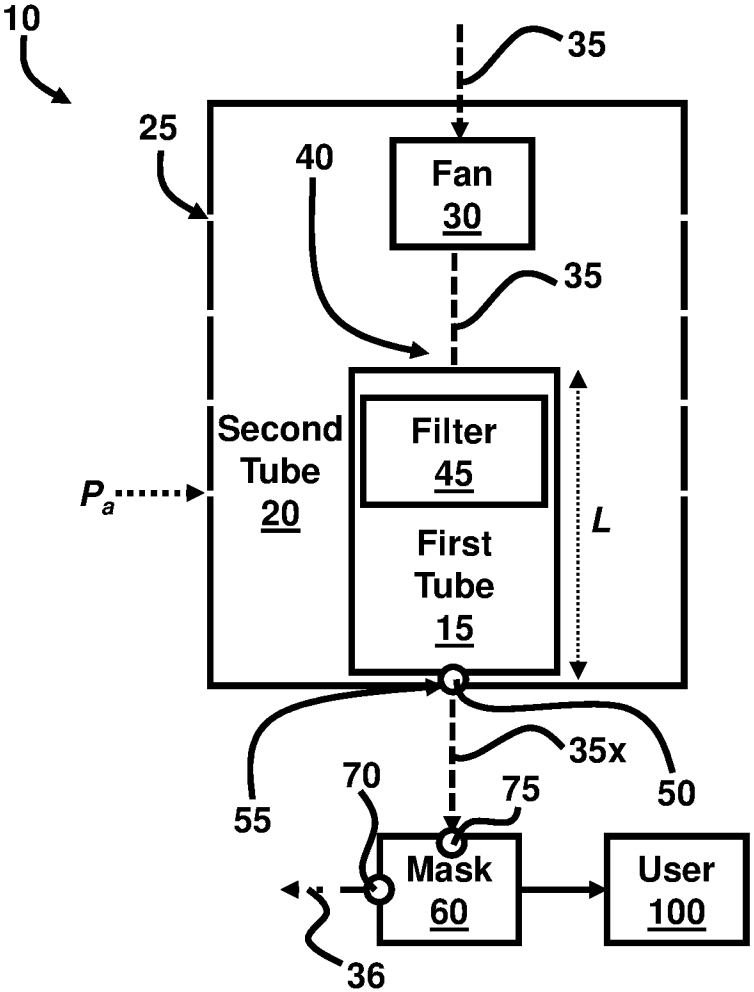
FIG. 1 is a block diagram illustrating an air purifier according to the embodiments herein.

As shown in FIG. 1, a portable air purifier 10 comprises a collapsible first tube 15, and a firm second tube 20 that houses the first tube 15. The first tube 15 may be collapsible and expandable based on pressure Pa being asserted thereon. The second tube 20 comprises perforations 25. The perforations 25 may be sized to allow atmospheric pressure Pa to transfer to the first tube 15. The first tube 15 and the second tube 20 may be made of plastic or any suitable type of material. Additionally, the first tube 15 and the second tube 20 may be made of translucent materials or opaque materials. However, the second tube 20 is structurally more rigid than the first tube 15. The first tube 15 is dimensioned and configured to hold enough air volume for 2-3 breaths (e.g., approximately 1.5 liters of air). In a non-limiting example, the first tube 15 may be approximately 3 inches in diameter, although other dimensions are possible, and the embodiments herein are not restricted to this particular size.

A fan 30 is provided in the air purifier 10 such that the fan 30 brings air 35 into a first end 40 of the first tube 15 and pushes the air 35 through the first tube 15. A multi-part filter 45 is arranged in a concentric configuration inside the first tube 15. The multi-part filter 45 is to filter 45 the air 35 as the air 35 proceeds through the first tube 15. The filter 45 creates filtered air 35*x* in the first tube 15. The filter 45 may be removable and replaced with new filters, as needed. The air purifier 10 comprises an outlet 50 at a second end 55 of the first tube 15. The outlet 50 is to discharge filtered air 35*x* from the first tube 15. The air purifier 10 comprises a breathing mask 60 coupled to the outlet 50 to receive the filtered air 35*x*.

In an example, the breathing mask 60 may comprise a first valve 70 to discharge exhaled air 36 of a user 100, and a second valve 75 to prevent filtered air 35*x* from returning to the first tube 15. For example, the first valve 70 may be configured as a one-way valve to allow the outflow of air from breathing mask 60 (i.e., that allows the exit of the exhaled air 36 into the atmosphere) and restrict the inflow of ambient air (e.g., air that is not from the first tube 15) into the breathing mask 60. In an example, the first valve 70 may be a mechanical valve that is controlled by the force of the exhaled air directed thereupon. The second valve 75 may also be configured as a one-way valve to prevent the filtered air 35*x* from returning back to the first tube 15 after entering into the breathing mask 60. In an example, the second valve 75 may be a mechanical valve that is controlled by the force of the filtered air 35*x* directed into the breathing mask 60 from the first tube 15. The first tube 15 is configured to store the filtered air 35*x* such that the filtered air 35*x* is then readily available for the next inhalation by the user 100 through the breathing mask 60. The first tube 15 is configured to store about 1.5 liters and is collapsible to ensure no undue falling of pressure during inhalation. Further, this storage of the filtered air 35*x* in the first tube 15 is in proximity to the breathing mask 60 to allow easy, and direct air flow to the breathing mask 60. The perforations 25 of the second tube 20 are configured to allow the first tube 15 to maintain pressure during inhalation of the filtered air 35*x* by the user 100.

Figure 2B:
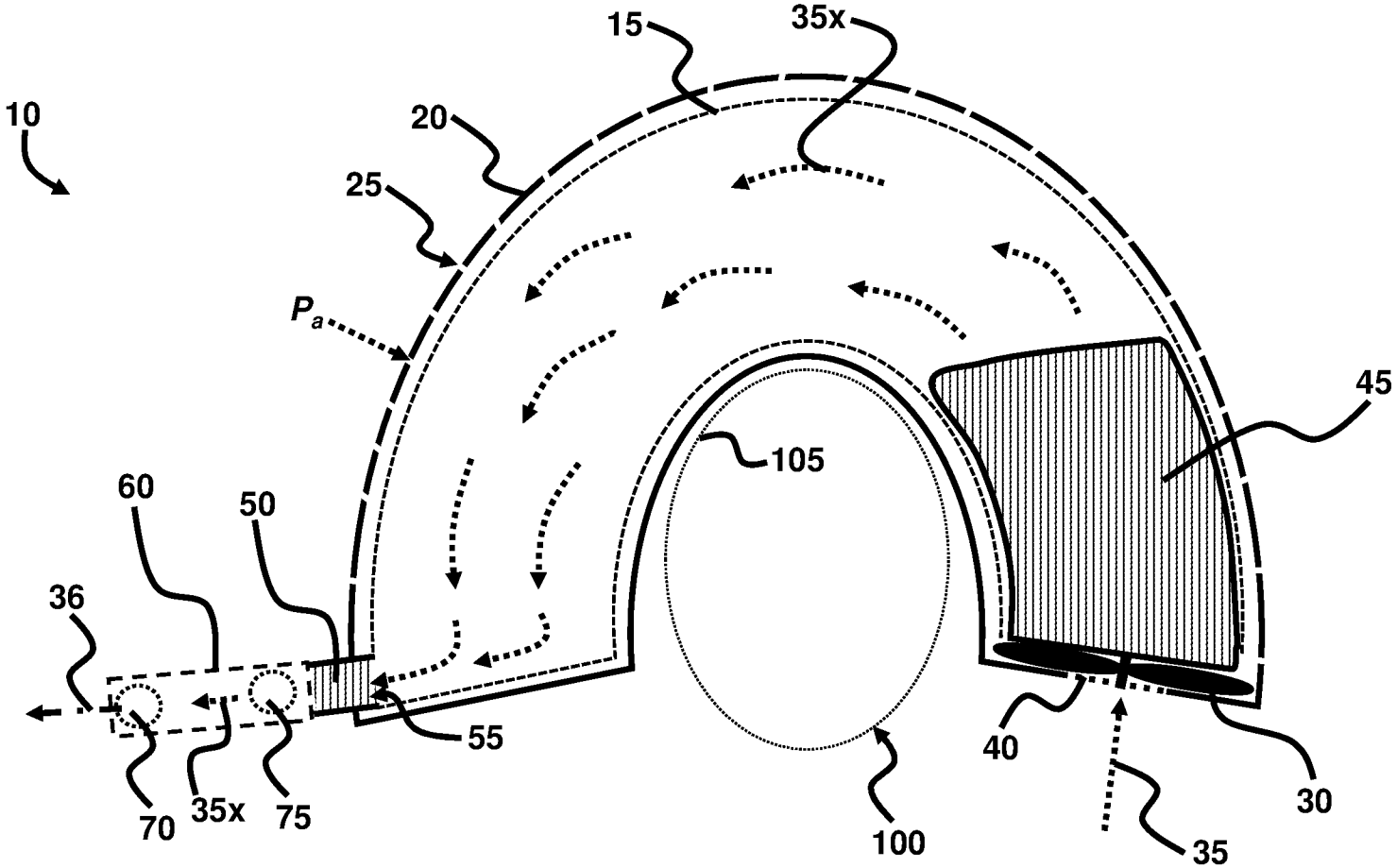
FIG. 2B is a cross-sectional diagram illustrating the air purifier of FIG. 2A according to the embodiments herein.

As shown in FIGS. 2A and 2B, with reference to FIG. 1, the first tube 15 and the second tube 20 may have an elongated semi-circular flexible configuration to fit around the neck 105 of a user 100. For example, the first tube 15 can be configured to be worn on the shoulders of the user 100 and is in the shape of a neck pillow (although other shapes and configurations are possible). Moreover, the outlet 50 may be configured as a threaded outlet port to engage a complementary threaded portion of the breathing mask 50. The Additionally, the spacing between the first tube 15 and the second tube 20 may be sufficient to allow the first tube 15 to increase/decrease in size based on the air pressure within the first tube 15) and/or the atmospheric pressure Pa being directed thereon through the perforations 25 of the second tube 20. The flow of the air 35 and then the filtered air 35*x* in the first tube 15 proceeds from the first end 40 to the second end 55.

Figure 3B:
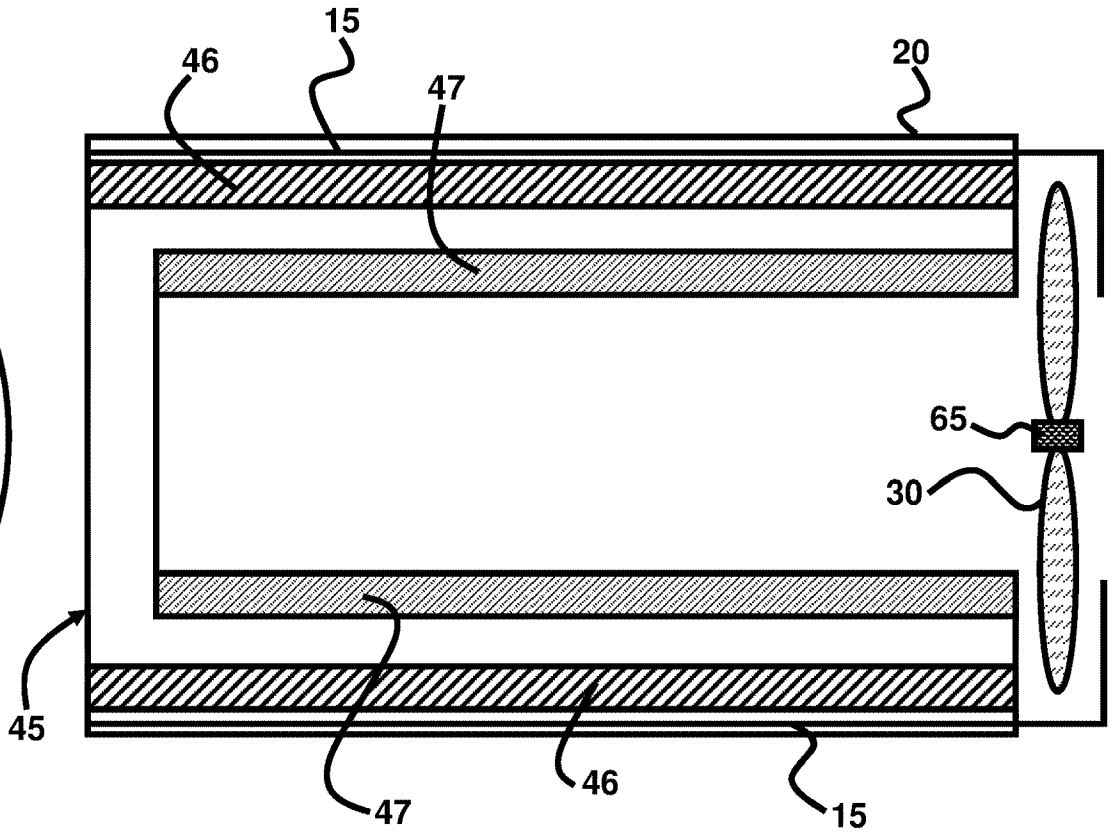
FIG. 3B is a longitudinal cross-sectional diagram illustrating the filter of an air purifier according to the embodiments herein.
Figure 3A:
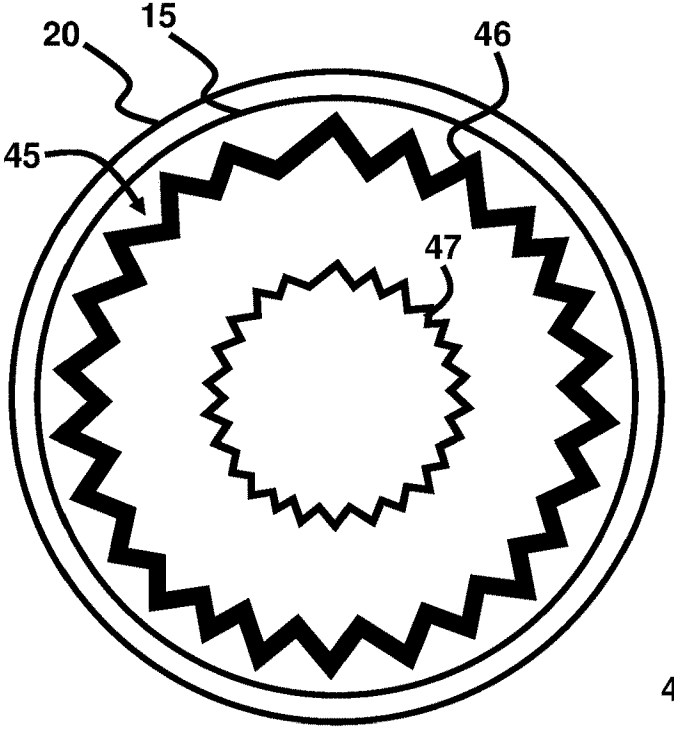
FIG. 3A is a lateral cross-sectional diagram illustrating the filter of an air purifier according to the embodiments herein.

As shown in FIGS. 3A and 3B, with reference to FIGS. 1 through 2B, in an example, the filter 45 may be a corrugated filter. In another example, the filter 45 may comprise a two-part filter comprising an outer filter portion 46 and an inner filter portion 47 that are arranged in a concentric configuration such that the outer filter portion 46 surrounds the inner filter portion 47. In an example, the filter 45 may extend through only a portion of the first tube 15. For example, the filter 45 may extend through approximately one-quarter of the length L of the first tube 15. In another example, the filter 45 may extend throughout the entire length L of the first tube 15.

Figure 4:
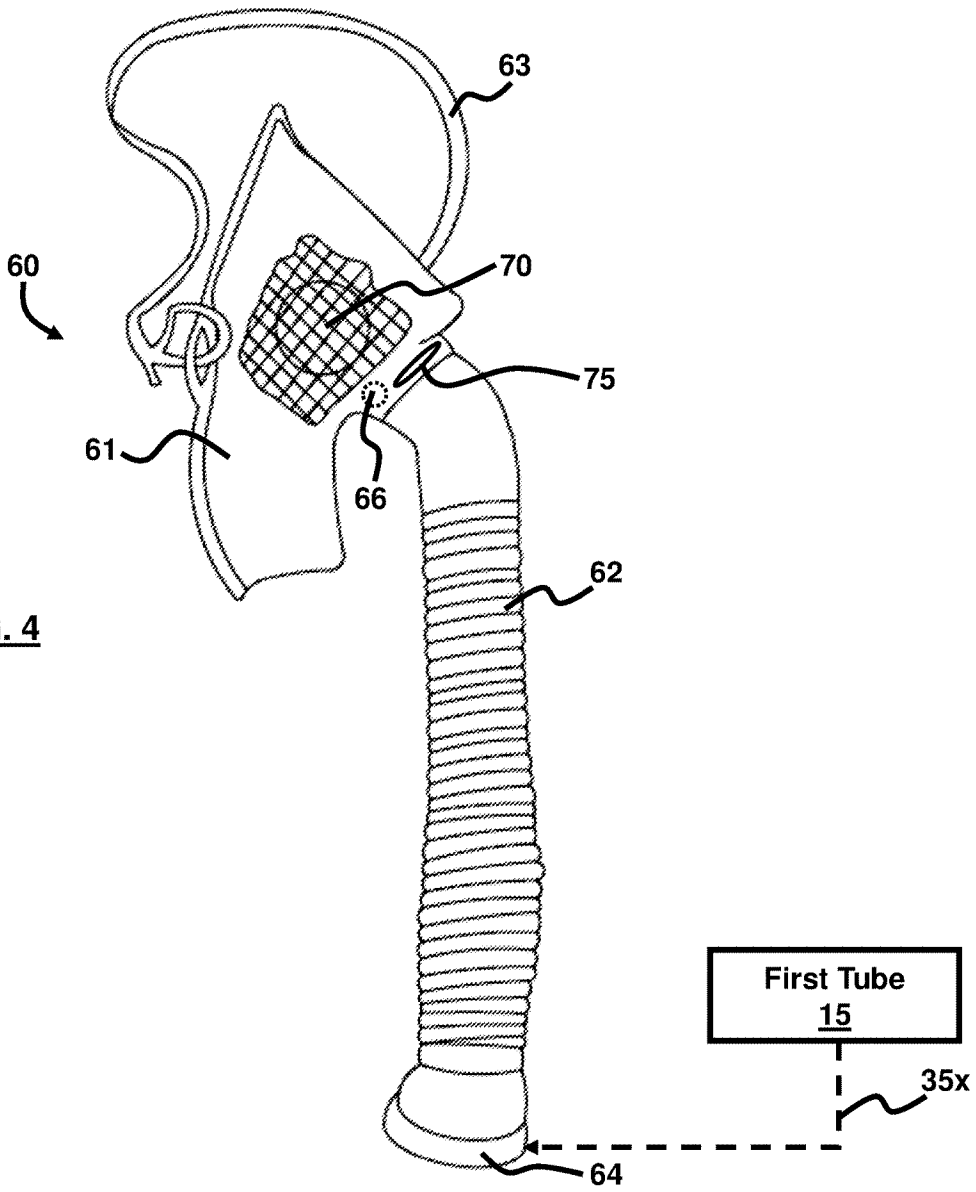
FIG. 4 is a schematic diagram illustrating a mask for an air purifier according to the embodiments herein.

As shown in FIG. 4, with reference to FIGS. 1 through 3B, the breathing mask 60 may comprise a mask portion 61 configured to fit over the nose and mouth of a user 100. The mask portion 61 may contain the first valve 70 to discharge the exhaled air 36 from the user 100. Furthermore, the exhaled air 36 may be sterilized upon discharge from the first valve 70 using a suitable sterilization technique such as described in U.S. Pat. No. 11,191,864 issued to Singal et al., the complete disclosure of which, in its entirety, is herein incorporated by reference.

Moreover, the breathing mask 60 may comprise a strap 63 operatively connected to the mask portion 61 such that the strap 63 may fit around the head and/or neck 105 of the user 100 and adjusted to create a tighter seal of the mask portion 61 against the nose and mouth of the user 100. The breathing mask 60 further comprises a corrugated tube portion 62 connected to the mask portion 61 such that the tube portion 62 creates an air passageway into the mask portion 61 to allow the filtered air 35*x* from the first tube 15 of the air purifier 10 to enter into the mask portion 61 to allow the user 100 to breath the filtered air 35*x*. The first tube 15 should be located close to the face of the user 100 so as to use the shortest possible length of the tube portion 62 to breathing mask 60 (shown in FIG. 4). Resistance to air flow is directly proportional to the length of the tube portion 62. Therefore, the embodiments herein provide that the air purifier 10 can be worn around the neck 105 of the user 100 such that the weight of the air purifier 10 can be borne by the shoulders of the user 100.

A connecting portion 64 is attached to the tube portion 62 such that the connecting portion 64 connects to the outlet 50 at the second end 55 of the first tube 15. In an example, the connecting portion 64 may comprise threads (not shown) that are complementary to threads of the outlet 50. In other examples, the connecting portion 64 may press fit around the outlet 50. Moreover, the connecting portion 64 and the outlet 50 may be connected or joined in any suitable manner to create a suitably tight seal to prevent leakage of the filtered air 35*x* from escaping the first tube 15 and to direct as much of the filtered air 35*x* as possible into the tube portion 62 and then into the mask portion 61 for inhalation by the user 100 so as not to waste any of the filtered air 35*x*.

Leaks around the face decrease the efficacy of the breathing mask 60 due to unfiltered air being sucked into the breathing mask 60 for inhalation by the user 100. Accordingly, the breathing mask 60 provided by the embodiments herein maintains positive pressure through the tube portion 62 and/or in the connected first tube 15. With positive pressure, any leaks would be outward from the breathing mask 60 rather into the breathing mask 60. The positive pressure is created by the fan 30 pushing the air 35 into the first tube 15.

Figure 5:
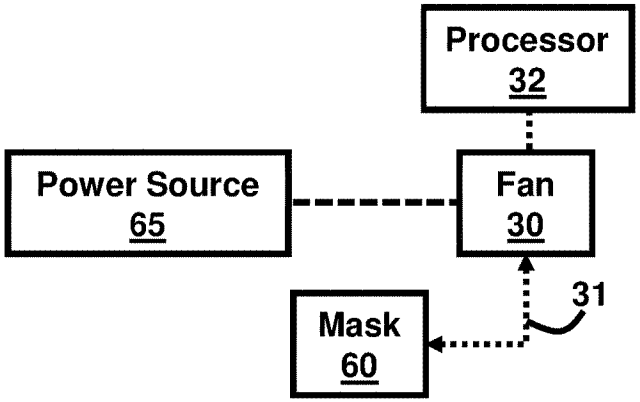
FIG. 5 is a block diagram illustrating a fan and power source according to the embodiments herein.

As shown in FIG. 5, with reference to FIGS. 1 through 4B, the portable air purifier 10 may comprise a power source 65 electrically connected to the fan 30, wherein the power source 65 is to power the fan 30. The power source 65 may comprise any or a combination of a charging adapter, batteries, power bank, USB charging port, and electrical power source. In another example, the power source 65 may be a DC motor (e.g., a 5-volt, 0.1 amp DC motor, etc.). In other examples, the power source 65 may be an electronic device such as a smartphone that the user 100 connects to the fan 30 to provide power to the fan 30. Alternatively, rechargeable or non-rechargeable batteries could be used as the power source 65.

Figure 6B:
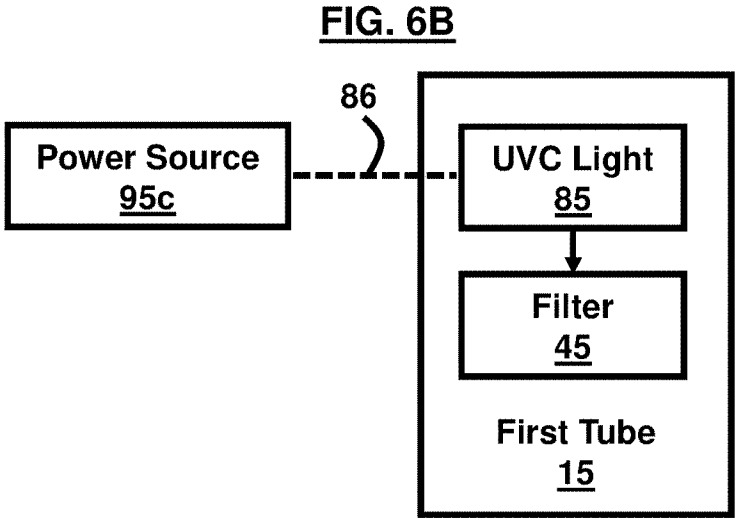
FIG. 6B is another block diagram illustrating a UVC light used in the first tube of an air purifier according to the embodiments herein.
Figure 6A:
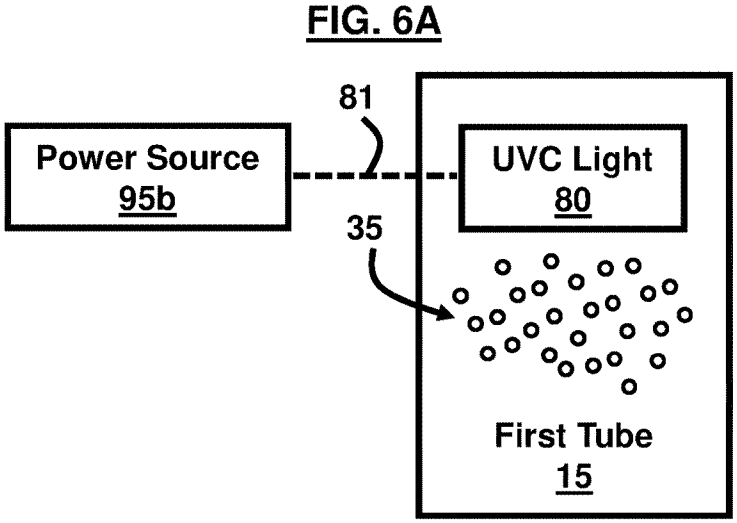
FIG. 6A is a block diagram illustrating a UVC light used in the first tube of an air purifier according to the embodiments herein.

As shown in FIG. 6A, with reference to FIGS. 1 through 5, the first tube 15 may comprise a UVC light 80 that sterilizes the filtered air 35*x*. For example, the UVC light 80 may be configured as UVC producing LEDs. As shown in FIG. 6B, with reference to FIGS. 1 through 6A, the first tube 15 may comprise a UVC light 85 that sterilizes the filter 45. For example, the UVC light 85 may be configured as UVC producing LEDs. Live viruses could accumulate on the filter 45, and thus using the UVC light 85 can keep the filter 45 sterile. Any of the UVC lights 80, 85 are configured to emit UV light of a predefined wavelength and high efficiency, with a very small amount of power at low voltage levels for a longer period of time. In addition, because the UVC lights 80, 85 may be configured as LEDs, they produce no ozone and very little heat.

Conventional mercury UV lamps produce ozone, which is toxic to the lungs. They generate UV radiation in all wavelengths—A, B, and C. Of these, only UV-C has the ability to sterilize. UV-A and UV-B have essentially wasted outputs along with heat. The LEDs used for the UVC lights 80, 85 and utilized in accordance with the embodiments herein avoid all of these shortcomings; i.e., no ozone, very little heat, and specifically germicidal radiation at low power consumption, among other attributes.

As shown in FIGS. 6A through 6C, an electrical power source 95*a*, 95*b*, 95*c* may provide power to the UVC lights 80, 85, respectively. The power source 95*a*, 95*b*, 95*c* may comprise any or a combination of a charging adapter, batteries, power bank, USB charging port, and electrical power source. In another embodiment, the power source 95*a*, 95*b*, 95*c* and the power source 65 may be the same component. In still another embodiment, the power source 95*a*, 95*b*, 95*c* may be an electronic device such as a smartphone that the user 100 connects to the UVC lights 80, 85 to provide power to the UVC lights 80, 85.

Figure 7A:
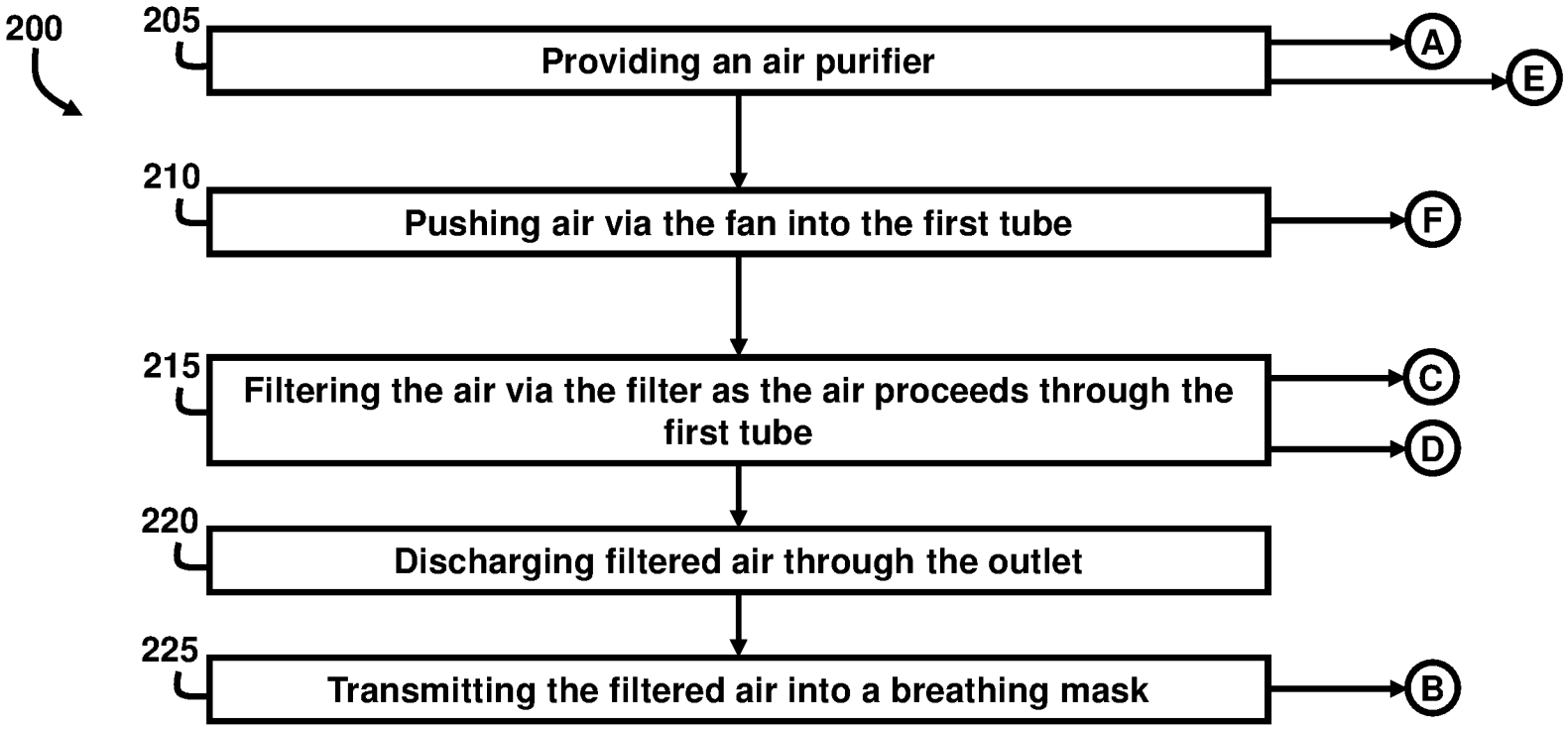
FIG. 7A is a flow diagram illustrating a method of filtering air according to the embodiments herein.

FIGS. 7A through 7G, with reference to FIGS. 1 through 6C, are flow diagrams illustrating a method 200 for filtering air 35. As shown in FIG. 7A, method 200 comprises providing (205) an air purifier 10 comprising a collapsible first tube 15, a perforated firm second tube 20 that houses the first tube 15, a fan 30 adjacent to a first end 40 of the first tube 15, a multi-part filter 45 arranged in a concentric configuration inside the first tube 15, an outlet 50 at a second end 55 of the first tube 15, and a breathing mask 60 coupled to the outlet 50. The filter 45 can eliminate 99.9% of pathogen particles down to the size of virus droplets; i.e., 0.3 micro-meters. By using the multiple filters 46, 47 in series, the effectiveness of the overall filter 45 is greatly enhanced. Method 200 further comprises pushing (210) air 35 via the fan 30 into the first tube 15; filtering (215) the air 35 via the filter 45 as the air 35 proceeds through the first tube 15; discharging (220) filtered air 35*x* through the outlet 50; and transmitting (225) the filtered air 35*x* into a breathing mask 60.

Figure 7B:
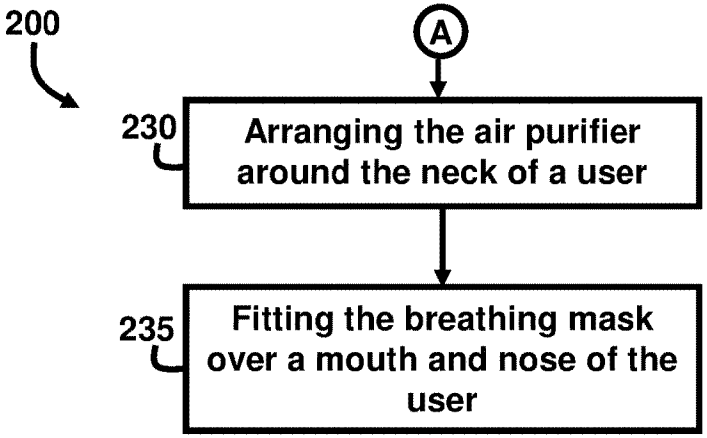
FIG. 7B is a flow diagram illustrating a method of using a breathing mask according to the embodiments herein.
Figure 7C:
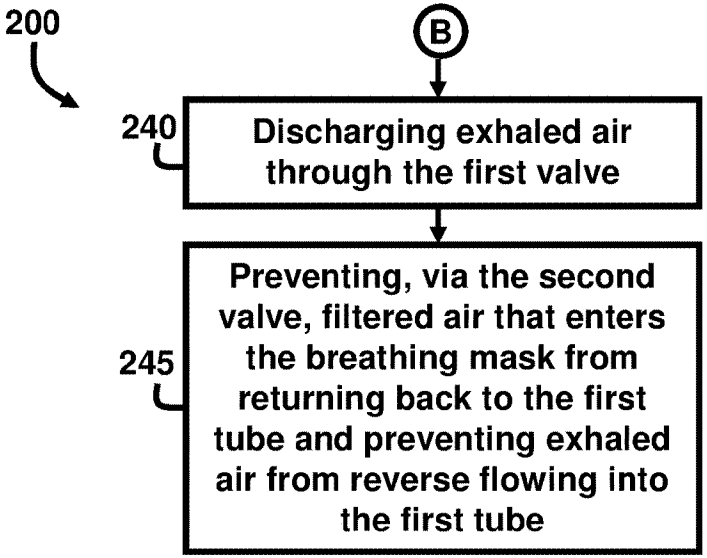
FIG. 7C is a flow diagram illustrating a method of discharging exhaled air from a breathing mask according to the embodiments herein.

As shown in FIG. 7B, method 200 may further comprise arranging (230) the air purifier 10 around a neck 105 of a user 100; and fitting (235) the breathing mask 60 over a mouth and nose of the user 100. The strap 63 of the breathing mask 60 may allow the user 100 to tighten or loosen the seal of the breathing mask 60 in order to provide for a comfortable fit of the breathing mask 60 for the user 100. The breathing mask 60 may comprise a first valve 70, and as shown in FIG. 7C, method 200 may further comprise discharging (240) exhaled air 36 through the first valve 70, and preventing (245), via the second valve 75, filtered air 35*x* that enters the breathing mask 60 from returning back to the first tube 15 and preventing exhaled air 36 from reverse flowing into the first tube 15. In an example, the first valve 70 may operate such that the force of the exhaled air 36 causes the first valve 70 to open in order to discharge the exhaled air 36 from the breathing mask 60. In an example, the second valve 75 may be positioned at an inlet of the breathing mask 60 so as to allow the filtered air 35*x* to enter the breathing mask 60 but prevent reverse flow back into the first tube 15 during exhalation of the exhaled air 36.

Figure 7D:
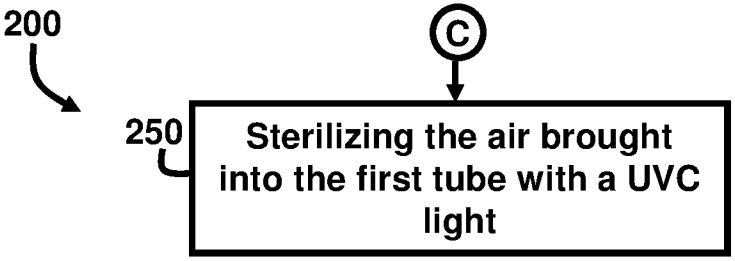
FIG. 7D is a flow diagram illustrating a method of sterilizing filtered air in the first tube of an air purifier according to the embodiments herein.
Figure 7E:
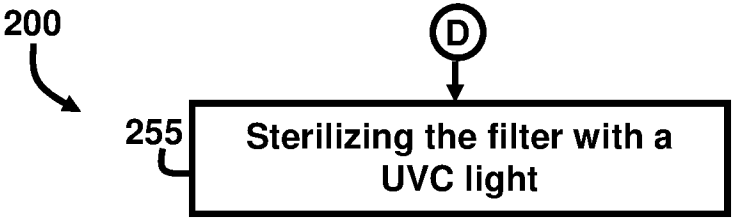
FIG. 7E is a flow diagram illustrating a method of sterilizing the filter of an air purifier according to the embodiments herein.

As shown in FIG. 7D, method 200 may further comprise sterilizing (250) the air 35 brought into the first tube 15 with a UVC light 80. For example, the UVC light 80 may be configured as UVC producing LEDs. As shown in FIG. 7E, method 200 may further comprise sterilizing (255) the filter 45 with a UVC light 85. For example, the UVC light 85 may be configured as UVC producing LEDs.

Any of the UVC lights 80, 85 may operate using milliamps of current at 5 volts power input. Moreover, any of the UVC lights 80, 85 can be wired to a cable 76, 81, 86, respectively with USB A type male connectors, for example. These USB A connectors can be plugged into the power sources 95*a*, 95*b*, 95*c*, respectively, which could be commercially available "power banks (e.g., such as those used to charge mobile phones), or directly to mobile phones, for example. Any of the UVC lights 80, 85 are configured to produce the predefined wavelength of light and can be selected and/or controlled depending upon the specific sensitivity of particular pathogens present in the air 35.

It is challenging to define and isolate the volume of air that requires disinfection rather than the entire atmosphere. Using the air purifier 10 with a volume of about 1.5 to 2 liters, the air 35 can be disinfected prior to being breathed in by the user 100. As the filtered air 35*x* is breathed in by the user 100, the exhaled air 36 is constantly replaced with filtered air 35*x* from the first tube 15.

By breathing filtered air 35*x* through the breathing mask 60 that allows the flow of filtered air 35*x* in one direction only, the source and location of the breathable filtered air 35*x* can be controlled. An average person takes about 12 breaths a minute and inhales about 500 milliliters (mls) per breath. The first tube 15 of 1,500 mls volume would have sufficient air for three breaths. By allowing the air 35 and then filtered air 35*x* to flow in one direction through the first tube 15, one could treat the air 35 for about 15 seconds before being inhaled by the user 100. By installing any of the UVC lights 80, 85 producing UVC in the first tube 15 and/or breathing mask 60, this provides at least 15 seconds to sterilize the air 35 in the first tube 15 and/or breathing mask 60. Similarly, by breathing out (or exhaling air 36) into the breathing mask 60 with the one-way first valve 70, the exhaled air 36 can be passed into the atmosphere.

Figure 7F:
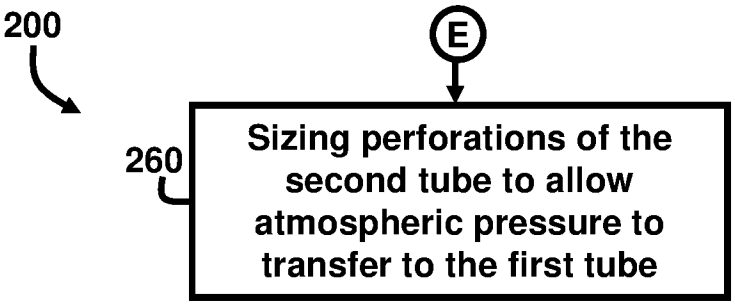
FIG. 7F is a flow diagram illustrating a method of transferring atmospheric pressure to the first tube of an air purifier according to the embodiments herein.

As shown in FIG. 7F, method 200 may further comprise sizing (260) perforations 25 of the second tube 20 to allow atmospheric pressure Pa to transfer to the first tube 15 (e.g., by compression from outside the second tube 20). The sizing process (260) would occur during the manufacturing of the air purifier 10 such that differently sized perforations 25 may be created for different second tubes 20. In another example, each second tube 20 may comprise differently sized perforations 25 on the same tube 20.

Figure 7G:
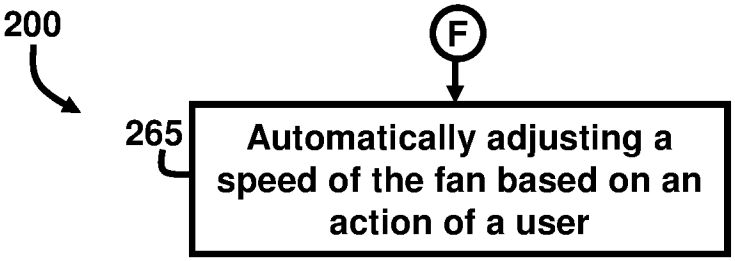
FIG. 7G is a flow diagram illustrating a method of controlling the fan of an air purifier according to the embodiments herein.

As shown in FIG. 7G, method 200 may further comprise automatically adjusting (265) a speed of the fan 30 based on an action of a user 100. In an example, the speed may increase with inhalation of the filtered air 35*x*, and the speed may decrease with exhalation of the air 36. In an embodiment, the adjusting process (265) may be based on the pressure differential between the breathing mask 60 and the first tube 15. For example, the fan 30 may comprise a feedback tube 31 (shown in FIG. 5) that is connected to the breathing mask 60 to provide feedback to the fan 30 depending on whether inhalation or exhalation is occurring. The fan 30 may comprise a microprocessor 32 (shown in FIG. 5), which may be programmed to identify the pressure in the breathing mask 60 using a pressure gauge 66 (shown in FIG. 5) and then to increase or decrease the speed of the fan 30 accordingly. Because there could be a fluctuation of pressure in the first tube 15 in different phases of respiration (i.e., inhalation vs. exhalation), the speed of the fan 30 may be controlled to change speeds such that the fan speed can be adjusted based on the air pressure in the breathing mask 60 as described above. Moreover, when the pressure is lower in the breathing mask 60 compared to in the first tube 15 (e.g., during inhalation), the speed of the fan 30 may increase. Additionally, when the pressure in the breathing mask 60 is higher compared to in the first tube 15 (e.g., during exhalation), the speed of the fan 30 may decrease.

Since the air purifier 10 disallows inhalation of untreated air, the user 100 can go into an area containing a contaminated atmosphere knowing that all the air 35 being inhaled has indeed been sterilized. Therefore, a user 100 can breathe without requiring pressure support from heavy/bulky peripheral equipment. The air purifier 10 and method 200 of filtering air 35 can overcome several problems. First, conventional masks offer an uncomfortable amount of resistance to the flow of air. Therefore, the air purifier 10 provides for the resistance to air flow through the filter 45 that is inversely proportional to the surface area through which the air 35 can move. The corrugated filters 46, 47 increase the surface area of the filter 45. Since the surface available directly on the breathing mask 60 is limited, placing the filter 45 near, but not in the breathing mask 60 and thus not on the face of a user 100, is helpful. Moreover, the fan 30 helps to push the air 35 through the filter 45 and the first tube 15 in a suitable manner to allow the user 100 to constantly receive fresh filtered air 35*x*.

Second, since the time for inhalation is only ⅓ of the respiratory cycle, an entire minute volume needs to traverse the breathing mask 60 in 20 seconds. Therefore, in another embodiment, the air purifier 10 provides a reservoir 99 (shown in FIG. 4) that is operatively connected to the connecting portion 64 of the tube portion 62 of the breathing mask 60, which stored filtered air 35*x* to provide the filtered air 35*x* immediately for inhalation into the breathing mask 60. Third, even with the first tube 15 holding filtered air 35*x* for the next breath by the user 100, when the filtered air 35*x* is inhaled, the pressure inside the first tube 15 could fall causing the filtered air 35*x* to leak into the breathing mask 60. Therefore, the embodiments herein provide that the first tube 15 is collapsible and enclosed in the firm second tube 20 containing perforations 25, which transfers the atmospheric pressure Pa to the first tube 15, which avoids the development of negative pressure therein. Moreover, the firm second tube 20 ensures a sufficient volume available to the collapsible first tube 15. Furthermore, the firm second tube 20 avoids any unsightly rhythmic inflation and deflation of the first tube 15 that may possibly occur. Fourth, the air purifier 10 should operate for approximately 8-12 hours without interruption or need for recharging of the various power sources 65, 95*a*, 95*b*, 95*c*. Thus, the embodiments herein provide for a power source 65 to power the fan 30 with high efficiency as well as power sources 95*a*, 95*b*, 95*c* to power the UVC lights 80, 85, respectively. Moreover, the adjustable speed of the fan 30 will further help decrease power consumption and increase the amount of time that the air purifier 10 can run without requiring recharging of the power source 65.

EXPERIMENTS

The embodiments herein were experimentally tested according to the following series of experiments. The specific devices, orientations, configurations, geometries, sizes, temperatures, timings, ratios, speeds, techniques, colors, and/or types and amounts of materials, etc. described in the experiments below are merely exemplary, and the embodiments herein are not restricted to any particular structure, property, technique, or material described below. Accordingly, the experiments are merely being presented to demonstrate the feasibility of the embodiments herein and are not meant to restrict how the invention may be practiced.

The experiments were conducted by Aerosol Research and Engineering Laboratories, Inc., Olathe, KS (USA). The purpose of the experiments was to characterize the single-pass efficacy of the air purifier 10 against aerosolized MS2 bacteriophage to determine whether the air purifier 10 is effective in reducing biological contaminants from the air. The air purifier 10 was tested in two configurations to test the capabilities of the air purifier 10.

The efficacy of the air purifier 10 was first assessed using a single pass bioaerosol challenge system with upstream and downstream sampling to assess the net reduction of bioaerosol passing through the air purifier 10. Then, the air purifier 10 was mounted to a small chamber and allowed to push out MS2 laden air for sampling. The air purifier 10 was tested in each configuration, in triplicate, with and without any of the UVC lights 80, 85.

Method 1 Configuration: Single Pass Testing—MS2 bacteriophage was aerosolized into a flow tube system via medical nebulizer. The air purifier 10 was adapted to one-inch stainless steel sanitary fittings to allow in-line integration into the bioaerosol challenge system. Midget impingers sampled upstream and downstream of the air purifier 10 for the duration of the trials at a flow rate of 11.0 LPM.

Method 2 Configuration: Chamber Testing—In the second configuration, MS2 bacteriophage was nebulized using a 6-jet jet nebulizer into a 150 L chamber. The air purifier 10 was affixed to the chamber so that the fan 30 of the air purifier 10 pulled in aerosol from the chamber and the outflow of the air purifier 10 pushed purified air out of the outlet 50. All impinger samples were serially diluted, plated, and enumerated in triplicate to yield viable bioaerosol concentrations up and downstream of the air purifier 10 to determine the single-pass reduction of viable bioaerosol with the air purifier 10 running for both configurations.

Results: When tested against the MS2 bacteriophage using the single pass setup, the air purifier 10 yielded an average 4.95 log reduction without any of the UVC lights 80, 85 and a 4.80 log reduction with the UVC light 80 in operation. When tested with the chamber set up, the air purifier 10 yielded an average 4.05 log reduction without any of the UVC lights 80, 85 on and a 4.04 log reduction with the UVC light 80 in operation. The air purifier 10 yielded a greater than 4.0 average log reduction for each test set up. This shows that the air purifier 10 was efficacious in both the dynamic single pass test system and in the more static system where the air purifier 10 sampled from a chamber, filled with MS2, where the only air movement through the air purifier 10 was supplied by the fan 30.

Although the UVC light 80 did not demonstrate improved aerosol results for the purposes of the experiment, the UVC light 80 can still be incorporated into the air purifier 10 as a filter decontamination mechanism. Moreover, while the efficacy of use of the UVC light 85 were not experimentally tested, it is considered that use of UVC lights 85 on a solid surface such as the filter 45 may prove to be more beneficial for destroying pathogens than the use of UVC light 80 on just the air 35. However, the use of UVC light 80 may provide some benefits of destroying airborne pathogens, nonetheless compared to not using UVC light 80.

Overview of the Experiment: Testing was conducted in two custom built single-pass systems. The first system was a custom stainless steel bioaerosol challenge system constructed of sanitary fittings; the second system incorporated attaching the air purifier 10 to a 150-liter Lexan chamber.

The effectiveness of the air purifier 10 was tested against aerosolized MS2 bacteriophage and assessed via an upstream and downstream sampling method to evaluate viable challenge bioaerosol concentration (pfu/L). Comparison of the upstream and downstream samples yielded the single-pass efficiency in terms of the percent of the bioaerosol challenge. The air purifier 10 was evaluated against a single viral RNA bacteriophage.

The air purifier 10 was adapted to the first challenge system which was constructed of stainless-steel sanitary fittings. Adaptors for mating the air purifier 10 and ensuring an airtight seal was accomplished using stainless steel sanitary fittings which were affixed via silicon sealant to the air purifier 10.

In the second system, the air purifier 10 was secured to the chamber wall of a 150-liter Lexan chamber via hot glue. A ⅜-inch sample probe was inserted through the wall of the chamber and run ½ inch into the air purifier 10 to sample the effluent air. A test matrix of all the trials that were run with the air purifier 10 can be found in FIG. 8.

Bioaerosol Sampling and Monitoring System—A pair of ChemGlass® midget impingers (available from ChemGlass Life Sciences, Vineland, NJ (USA)) were used for bioaerosol sample collection of for all of the test trials. The impingers were filled with 5 mL of phosphate buffered saline (PBS) solution for collection of the bioaerosols. The impingers were then serially diluted and plated for direct enumeration of plaque forming units (pfu). The impinger flow vacuum source was maintained using a valved Emerson® ⅓ hp rotary vane vacuum pump (available from Emerson Electric, St. Louis, MO (USA)) equipped with a 0-30 in Hg vacuum gauge (available from WIKA Instruments, Lawrenceville, GA (USA)).

The pump was operated at a negative pressure of 18 inches of Hg during all characterization and test sampling to assure critical flow conditions. The ChemGlass® midget impingers sample at a flow rate of 2.5 LPM. Sample flow rates were controlled using flow adjustment valves and in-line air flow meters. The midget impingers were used to reduce the airflow through the test system for low flow rate testing.

Figure 9:
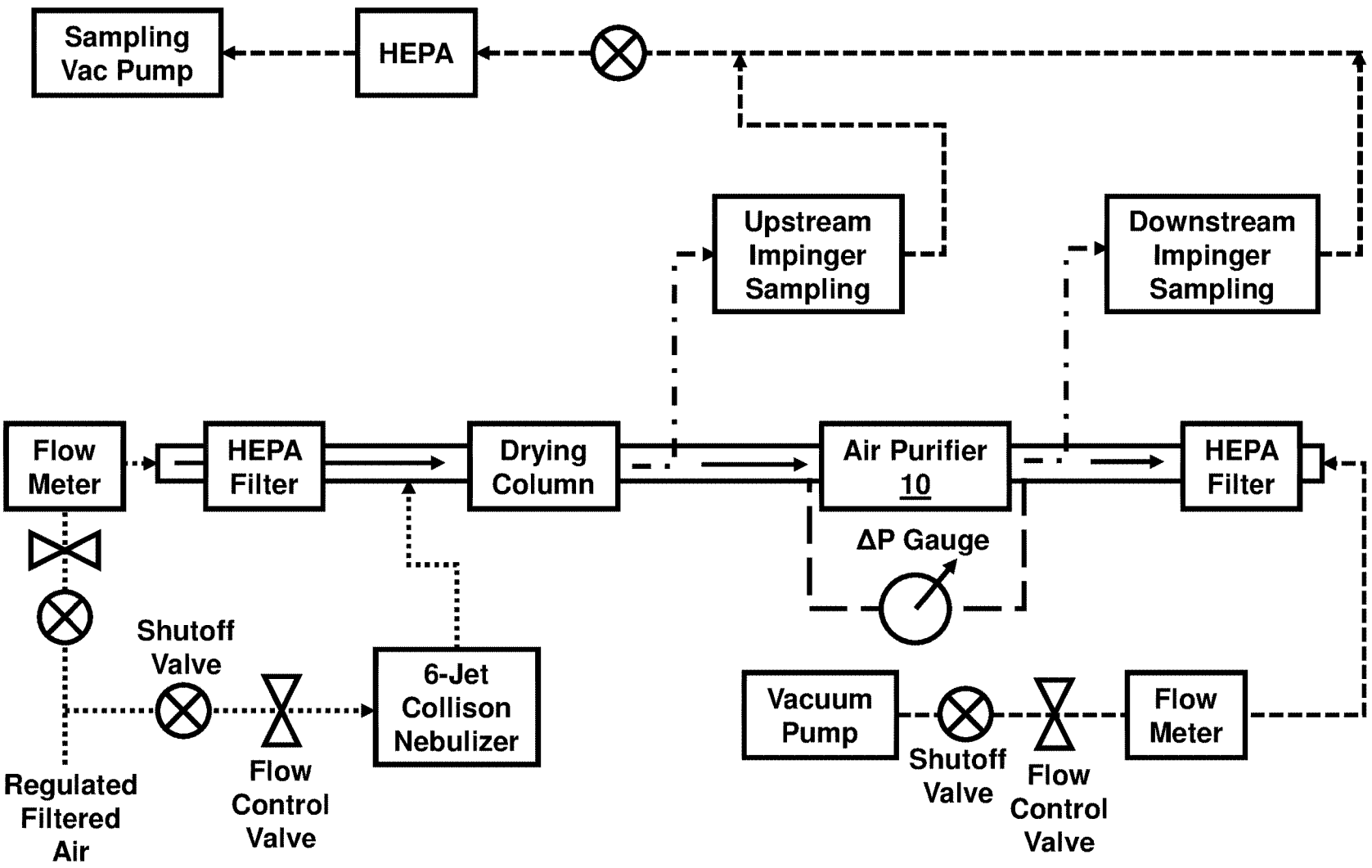
FIG. 9 is a schematic block diagram illustrating the experimental bioaerosol single pass challenge system and flow according to the embodiments herein.

Bioaerosol Testing Systems—Two custom bioaerosol testing systems were constructed to conduct testing on the air purifier 10. The first test system was assembled using stainless steel sanitary fittings, impingers, a medical nebulizer, HEPA filters and vacuum pumps. For this system the aerosol was nebulized into the system at 101 μm using house pressurized air before passing into a drying chamber to assure proper particle size was achieved. Following the drying chamber, the aerosol passed through the upstream sample port, followed by the air purifier 10, and then through the downstream sample port, and finally out of the test system through a HEPA filter. FIG. 9 shows a block diagram of this challenge system.

Figure 10:
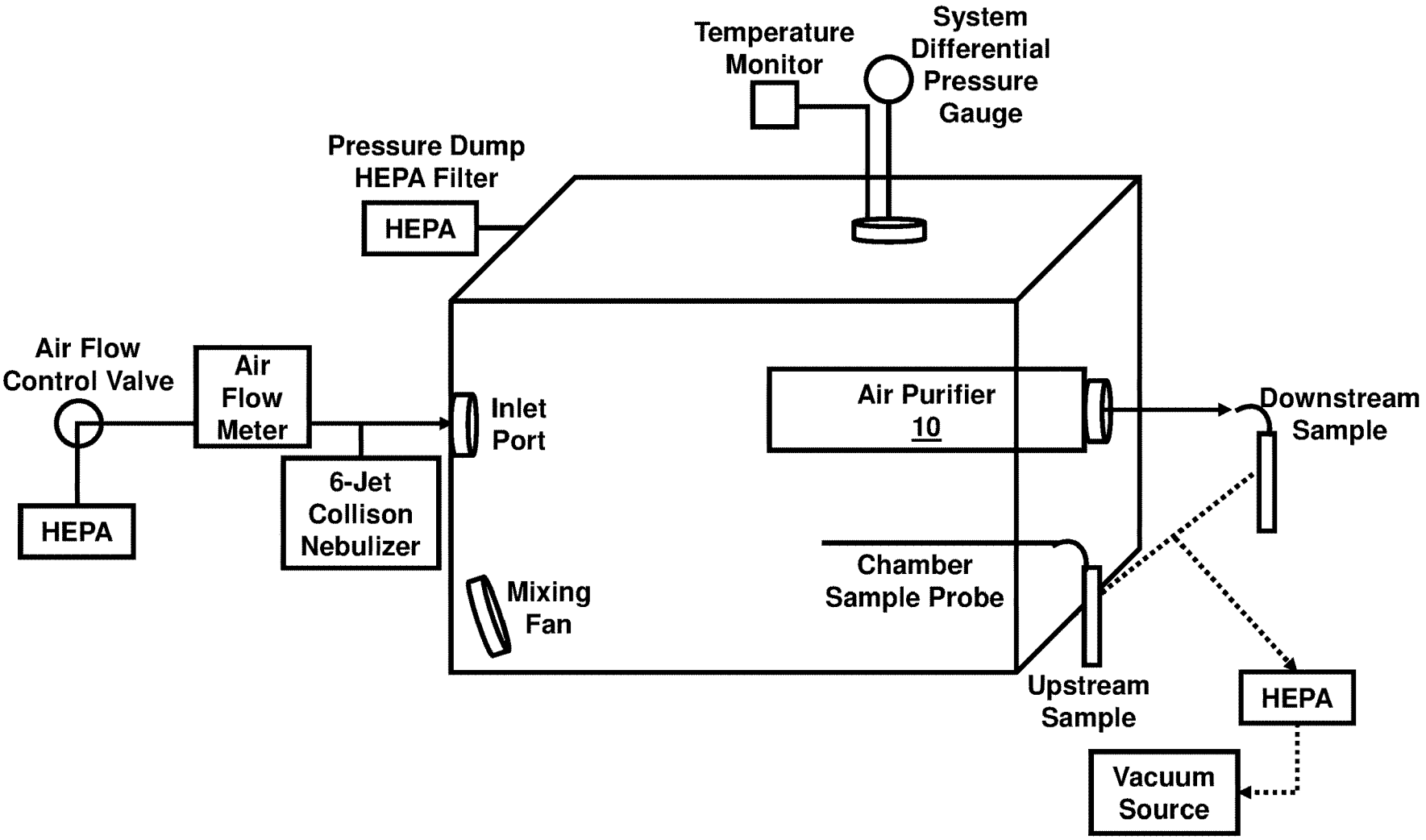
FIG. 10 is a schematic block diagram illustrating the experimental bioaerosol chamber test challenge system and flow according to the embodiments herein.

The second system was assembled by attaching the air purifier 10 to a sample port in the 150-liter chamber. After being dispersed by the nebulizer, the aerosol would mix in the chamber, using a mixing fan, before being passed through the air purifier 10 where it would be sampled through an inlet port. A diagram of this test system is shown in FIG. 10.

Bioaerosol Generation System—The 6-Jet Collison nebulizer (available from BGI Inc., Waltham, MA (USA)) has long been an industry standard technique for aerosolization of various liquids including biological stock suspensions. The Collison nebulizer is made from 316 stainless steel and utilizes silicone rubber O-Ring sealing gaskets and features an adjustable stem for varying liquid levels.

Species Selection—Species selection is based on BSL1 surrogates for a wide range of BSL 3 pathogenic microorganisms. It is routine in the bioaerosol field to use surrogate species to test performance against BSL3 microorganism decontamination due to the high cost and limited laboratory space associated with aerosol BSL 3 testing. MS2 (ATCC 15597-B1) is a viral RNA bacteriophage that is commonly used as a surrogate for the influenza virus and the norovirus.

MS2 has also recently been listed as a possible surrogate for the SARS-CoV-2 virus. The US Federal Drug Administration (FDA) guidance document; Enforcement Policy for Sterilizers, Disinfectant Devices, and Air Purifiers During the Coronavirus Disease 2019 (COVID-19) Public Health Emergency; states that lipid enveloped viruses such as coronaviruses are the least resistant microorganisms to disinfectants. MS2 does not have a lipid envelope. This appears to make it more resistant to disinfection than lipid viruses and therefore should be more resistant to kill when compared to SARS-CoV-2.

Viral Culture & Preparation—Pure strain viral seed stock (15597-B10) and host bacterium stock (15597) were obtained from ATCC. Host bacterium was grown in a similar fashion to vegetative cells in an appropriate liquid media. The liquid media was infected during the logarithmic growth cycle with the specific bacteriophage.

After an appropriate incubation time the cells were lysed, and the cellular debris separated by centrifugation. MS2 stock yields were greater than $1\times10^{11}$ plaque forming units per milliliter (pfu/mL) with a single amplification procedure. This stock MS2 viral solution was then diluted with PBS to approximately $1\times10^{10}$ plaque forming units per milliliter (pfu/mL) for use in the Collision nebulizer.

Bioaerosol Particle Size Data—Aerosol particle size distributions were sampled and measured with the APS prior to testing. The APS has a dynamic measurement range of 0.5 to 20 μm and was programmed to take consecutive real time one minute aerosol samples throughout the duration of each aerosol trial. Data was logged in real time to a laptop computer, regressed, and plotted.

Figure 11:
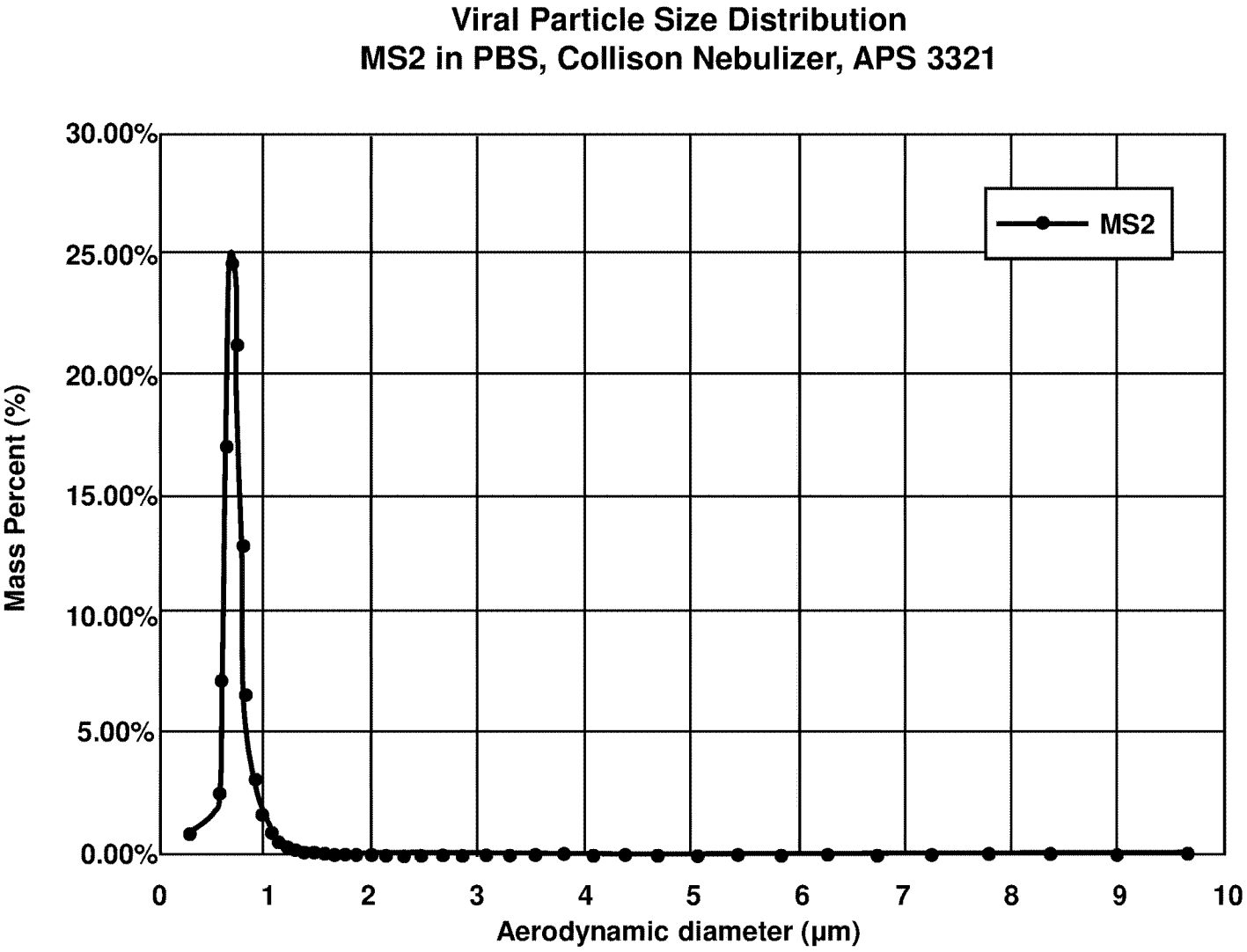
FIG. 11 is a graph illustrating the average particle size distribution of the MS2 bacteriophage used in the experiment according to the embodiments herein.

The aerosol size distribution of the MS2 particles shows that the aerosol from testing had a peak concentration at a size range of 0.7-0.8 μm. At this size range in a real-life scenario the MS2 would be breathed in and deposited into the lungs. Aerosol particle size distribution for MS2 is shown in FIG. 11.

Testing Methods:

Method 1: Single Pass System—A total of twelve (12) trials were conducted with the air purifier 10. Six trials were performed in each testing design. Three were performed with the UVC light 80 in operation and three without any of the UVC lights 80, 85 in operation.

For the tests with the UVC light 80 was in use, the air purifier 10 was allowed to warm up for approximately five (5) minutes prior to the initiation of the test to ensure that the UVC light 80 was functioning at full intensity. When the UVC light 80 was not in operation, it was left in the air purifier 10 but not powered on.

Prior to nebulization, system flow was turned on and 10 LPM of dilution air was circulated through the system. A drying column was integrated into the system which combined the bioaerosol with the dilution air to ensure the bioaerosol was dry.

Upstream and downstream sampling was performed using ChemGlass® midget impingers which sampled at a rate of 11.0 LPM. The sampling rate of the midget impingers was controlled via flow control valves and in-line flow meters.

A HEPA filtered excess air dump was integrated into the system to remove excess air from the system. This ensured that the only flow through the air purifier 10 was total flow pulled from the fan 30 of the air purifier 10 and by the main vacuum pump and the downstream impinger. The system was balanced with a Magnehelic® pressure gauge (available from Dwyer Instruments, LLC, Michigan City, IN (USA)). With a balanced system, the fan in the air purifier 10 was allowed to pull air through the system at its normal functioning rate.

The nebulizer was then turned on and operated at a pressure of 30 psi. Air was allowed to run through the system for at least two minutes to ensure uniform concentration of bioaerosols within the test system. Up and downstream impingers were turned on and sampled for five minutes to assure adequate sample collection in the downstream impinger. After testing, HEPA filtered dilution air, flowing at 30 LPM, was circulated through the system for 15-20 minutes to ensure that the system had no remaining bioaerosols. Once this system purge was completed, the air purifier 10 was decontaminated.

Method 2: Chamber Test System—Testing with the chamber system incorporated sealing the air purifier 10 to a sample port which allowed flow from the air purifier 10 to be channeled out of the chamber. To begin testing, the nebulizer was operated at 30 psi for 10 minutes prior to sampling. After 10 minutes, two impingers were hooked up to the system. The upstream impinger was hooked to a sample probe that sampled the chamber air concentration. The downstream impinger was hooked up to a sample probe which sampled the outflow air from the air purifier 10.

The impingers were operated simultaneously for 5 minutes for each trial. The nebulizer was left to supply constant aerosol to keep the chamber viable concentration constant during testing.

Plating and Enumeration—Impinger and stock biological cultures were serially diluted and plated in triplicate (multiple serial dilutions) using a small drop plaque assay technique onto tryptic soy agar plates. The plated cultures were incubated for 24-48 hours and enumerated and recorded.

Post-Testing Decontamination and Prep—Following each trial condition, the nebulizer was cleaned and filled with 35% hydrogen peroxide. The peroxide was nebulized for approximately fifteen minutes while 25 LPM of HEPA filtered air was run through the system. The nebulizer was then turned off and the dilution air continued to run through the system for an additional 30 minutes to ensure all hydrogen peroxide was removed from the system before beginning the next trial.

Data Analysis—The concentration of MS2, from the up and down stream sampling ports, was determined by the viable plaque counts from plating compared to the amount of air sampled over time. For the chamber tests, the chamber concentration was used as the upstream concentration. The concentrations upstream of the air purifier 10 were compared to the concentrations of MS2 downstream of the air purifier 10 to yield an average reduction over the 5-minute simultaneous sample period.

Method 1: Single Pass Results—The air purifier 10 achieved greater than a 4.0 net log reduction, >99.99%, with the single pass system both with and without any of the UVC lights 80, 85 in operation, with only UVC light 80 included in the experimental testing. With the UVC light 80 off, the air purifier 10 lowered the concentration of the air stream from 8.28E+04 pfu/l of air down to 9.09E-01 pfu/l of air for an average reduction of 4.95 log.

Figure 12:
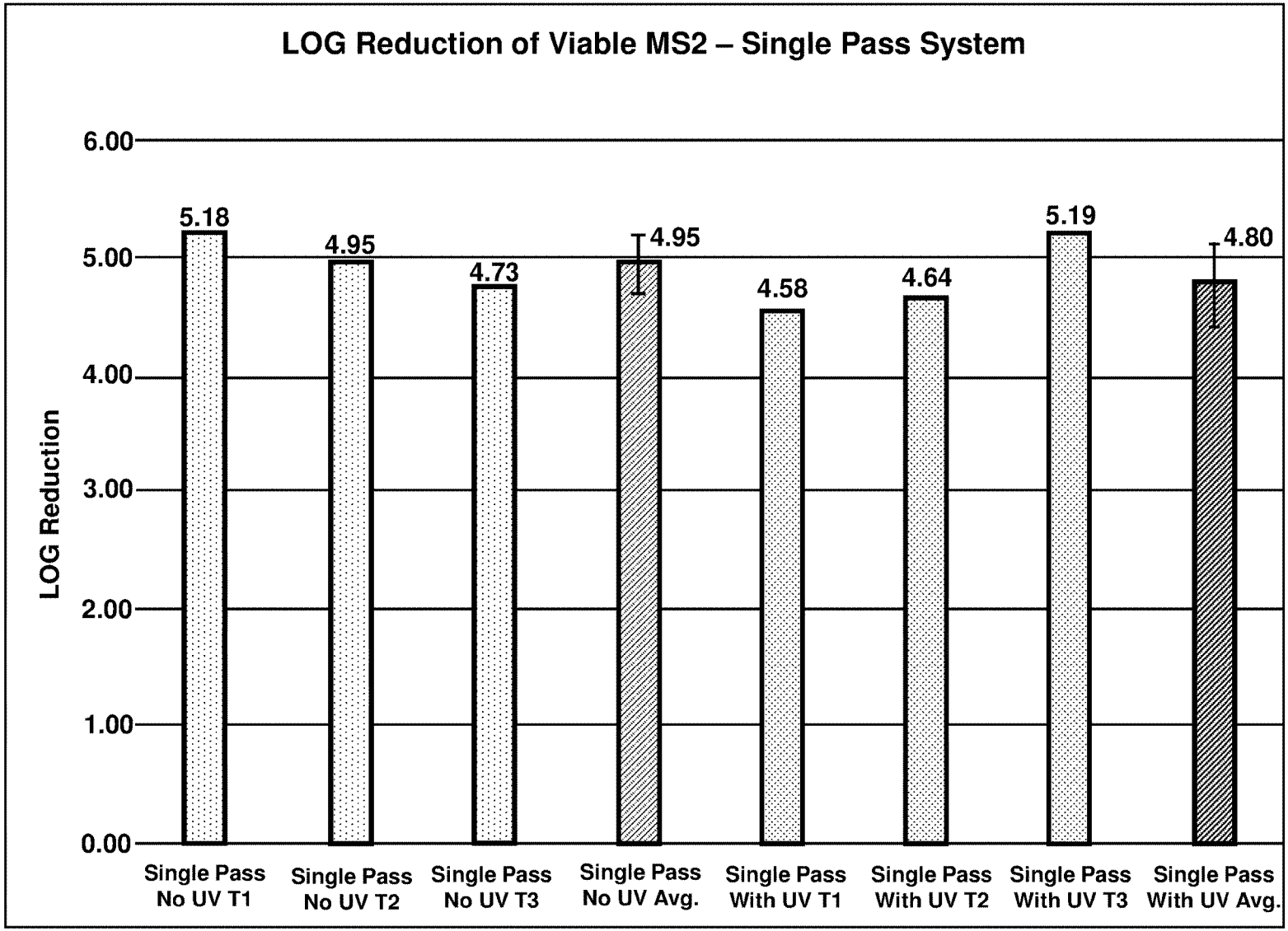
FIG. 12 is a graph illustrating the Log reduction results for the experimental single pass trials with and without UVC light according to the embodiments herein.
Figure 13:
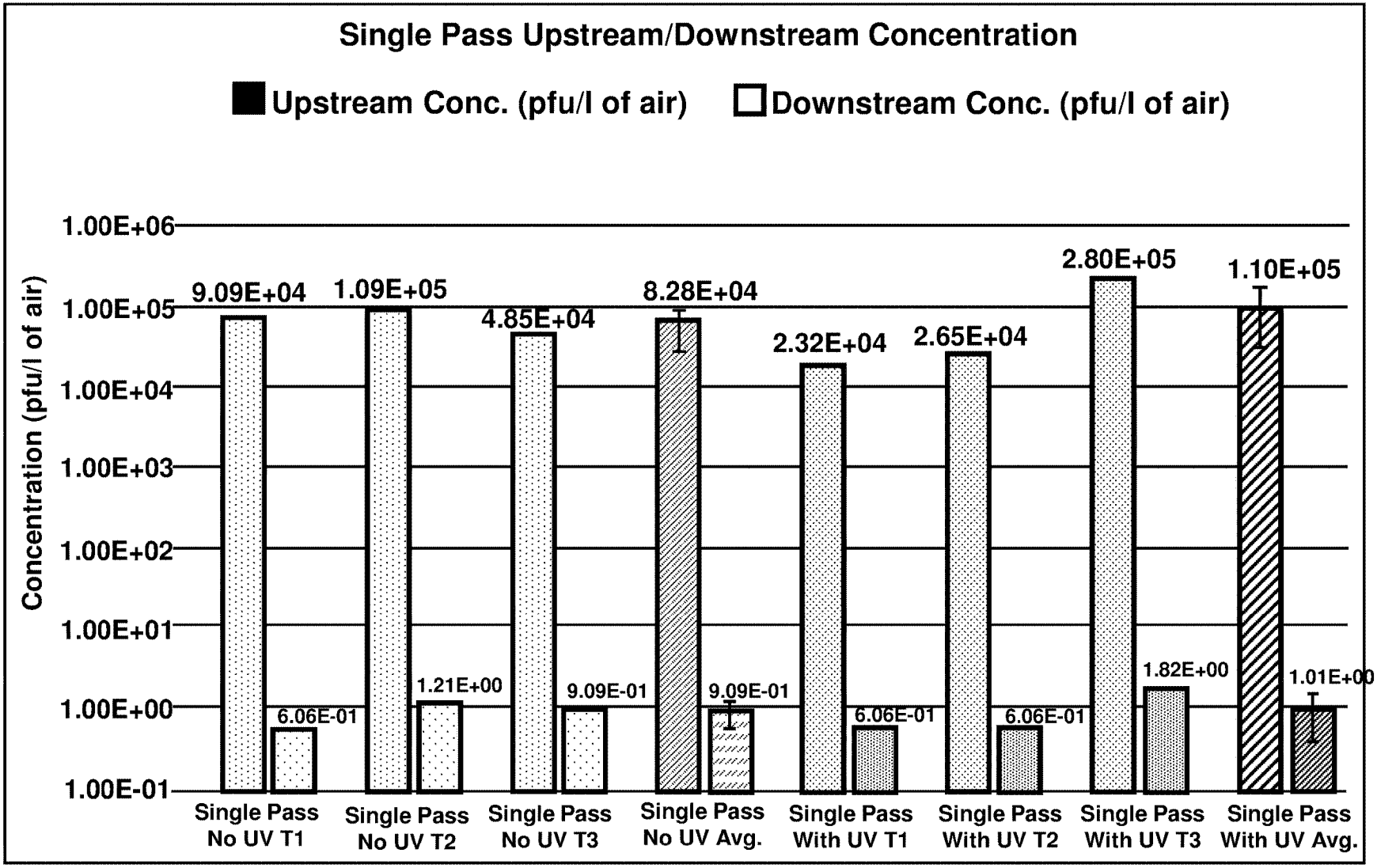
FIG. 13 is a graph illustrating the upstream and downstream concentrations for the experimental single pass system according to the embodiments herein.

With the UVC light 80 in operation, the air purifier 10 produced a similar result, lowering the average concentration from 1.10E+05 pfu/l of air to 1.01E+00 pfu/l of air for an average reduction of 4.80 log. The log reduction results are shown in FIG. 12. The upstream and downstream concentration average for each trial is shown in FIG. 13.

Method 2: Chamber Test Results—The air purifier 10 achieved less reduction for the trials done with the chamber system versus the single pass, both with and without the UVC light 80 in operation. With the UVC light 80 off, the air purifier 10 reduced the concentration of the system from 3.64E+03 pfu/l of air to 3.03E-01 pfu/l of air for an average reduction of 4.05 log.

Figure 14:
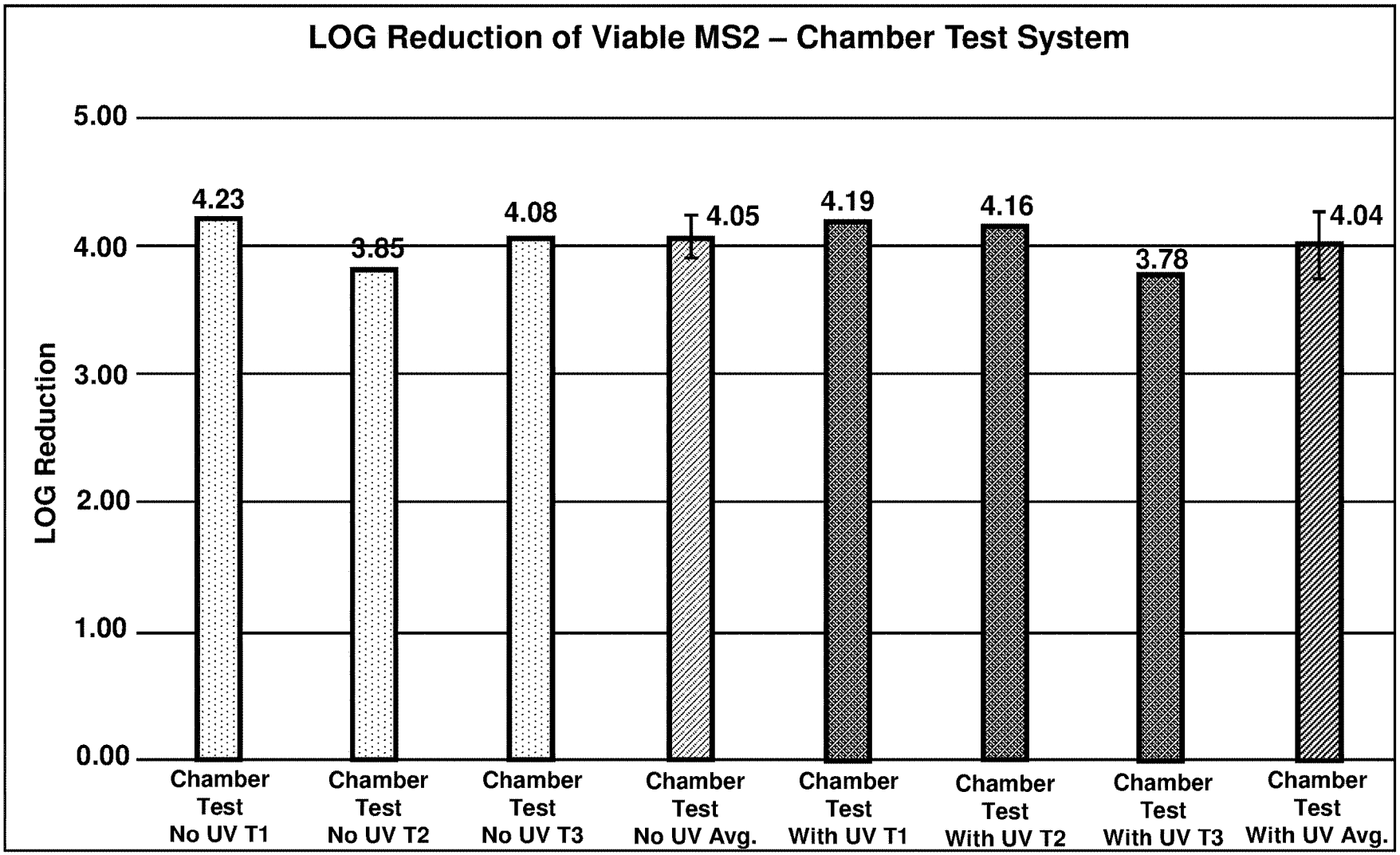
FIG. 14 is a graph illustrating the Log reduction results for the experimental chamber testing with and without UVC light according to the embodiments herein.
Figure 15:
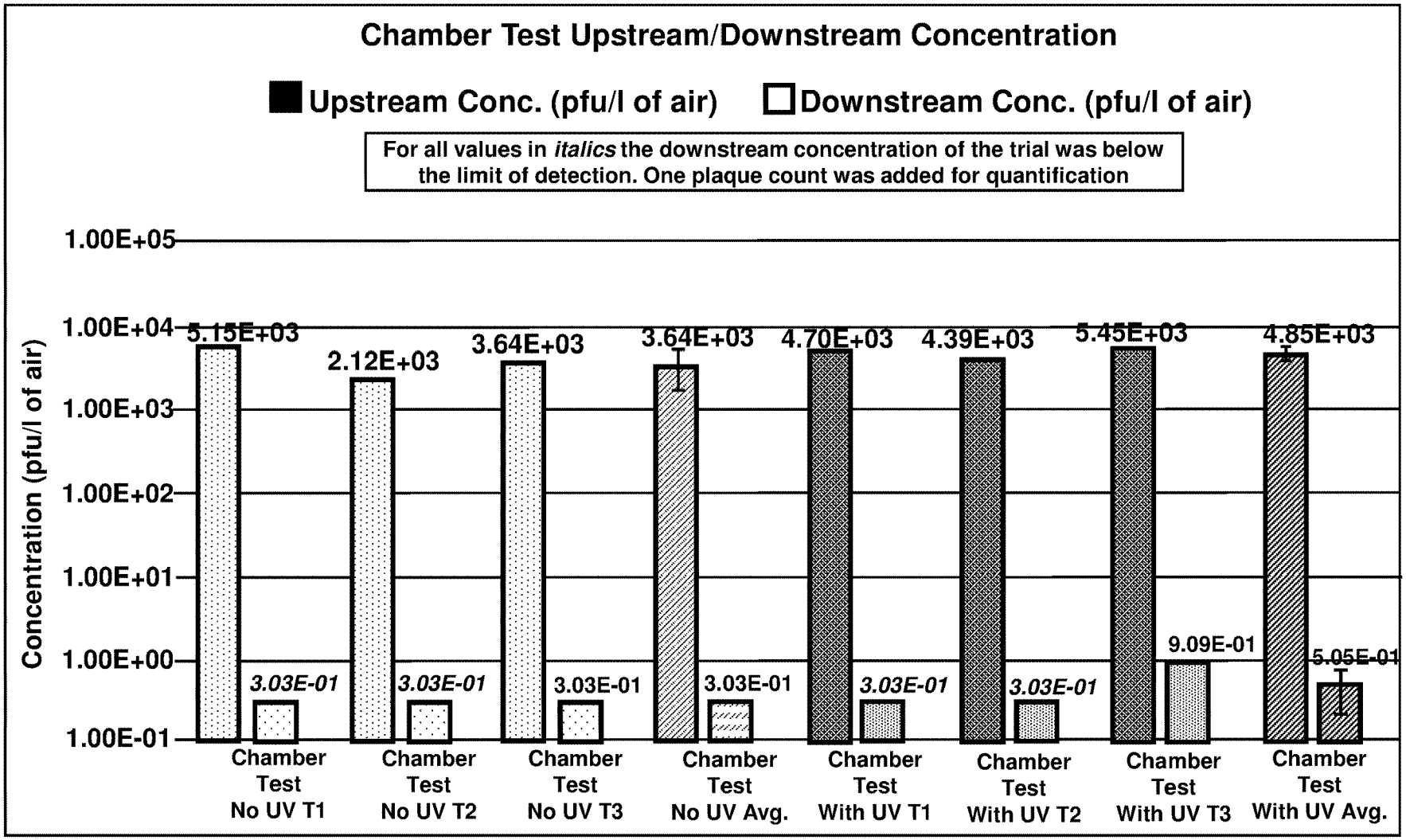
FIG. 15 is a graph illustrating the upstream and downstream concentrations of experimental trials with the chamber test system according to the embodiments herein.

With the UVC light 80 in operation, the air purifier 10 produced similar results lowering the average concentration from 4.85E+03 pfu/l of air to 5.05E-01 pfu/l of air for an average reduction of 4.04 log. The results in log reduction are shown in FIG. 14. The upstream and downstream concentration averages for each trial are shown in FIG. 15.

Experimental Test Results

The data indicates that the air purifier 10 showed efficacy against the MS2 bacteriophage in both systems it was tested in, both with and without the UVC light 80 in operation. The single pass system showed more overall reduction than the chamber test. However, this was likely due to the chamber test starting at a lower concentration. All downstream samples from the chamber test were at or near the limit of detection for sampling. Future testing could involve testing the air purifier 10 with this set up at a higher starting concentration.

Although the UVC light 80 did not improve aerosol reduction due to short exposure time, the UVC light 80 and UVC light 85 could still be used in the air purifier 10 as a self-decontaminating mechanism to keep the filter 45 clean. With constant exposure to the surface of the filter 45 UVC light 85 would have a greater chance of being effective.

The air purifier 10 achieved greater than 4.0 log average reduction for each test set. This demonstrated that the air purifier 10 was efficacious in both a dynamic single pass system, where the air purifier 10 was supplied MS2 through house filtered air, and in a more static system where the air purifier 10 sampled from a chamber filled with MS2 and the only air movement through the air purifier 10 was supplied by the fan 30. A summary table of the testing is shown in FIG. 16.

To evaluate the viable aerosol delivery efficiency and define operation parameters of the system, calculations based on (theoretical) 100% efficacy of aerosol dissemination were derived using the following steps:

Plating and enumeration of the biological to derive the concentration of the stock suspension ($C_s$) in pfu/mL or cfu/mL, or cfu/g for dry powder.

Collison 24 jet nebulizer use rate ($R_{neb}$) (volume of liquid generated by the nebulizer/time) at 28 psi air supply pressure=1.0 mL/min.

Collison 24 jet Generation time (t)=20 or 30 minutes, test dependent.

Chamber volume ($V_c$)=15,993 Liters

Assuming 100% efficiency, the quantity of aerosolized viable particles ($V_P$) per liter of air in or a given nebulizer stock concentration ($C_s$) is calculated as:

$$\text{Nebulizer: } V_P = \frac{C_s \cdot R_{neb}}{V_c} t$$

AGI Impinger:

Viable aerosol concentration collection ($C_a$)=cfu or pfu/L of chamber air.

Viable Impinger concentration collection ($C_{Imp}$)=cfu or pfu/mL from enumeration of impinger sample or filter sample.

Impinger sample collection volume ($I_{vol}$)=5 mL collection fluid/impinger, or extraction fluid for filter.

AGI impinger flow rate ($Q_{imp}$)=2.5 L/min.

AGI impinger time (t)=5 or 10 minutes, test dependent.

For viable impinger or filter aerosol concentration collection ($C_a$)=cfu or pfu/L of chamber air:

$$C_a = \frac{C_{Imp} \cdot I_{vol}}{Q_{imp}} t$$

The embodiments herein provide a unique self-contained and portable air purifier 10 and method 200 of filtering air 35, which overcomes several challenges in the conventional solutions. For example, the air purifier 10 and method 200 provides for a technique that removes more potentially breathable pathogens than the conventional solutions are demonstrated by the experimental results. Moreover, the air purifier 10 and method 200 alleviates the problem of reverse flow of filtered air 35*x*, thereby making the air purifier 10 and method 200 much more efficient in terms of the amount of filtered air 35*x* that is provided for breathing by a user 100 and reducing the amount of filtered air 35*x* that is wasted and/or sent back to the first tube 15. Furthermore, the fan 30 provided by the air purifier 10 and utilized by the method 200 is self-contained within the air purifier 10 to allow the air purifier 10 to be portable, thus overcoming the problem of bulky and heavy equipment for a user 100 to carry, and additionally the fan 30 provides for real-time feedback with the breathing mask 60 to determine if the flow rate of the air 35 that the air purifier 10 must intake should be adjusted. The air purifier 10 and method 200 provides 99.995% purified and filtered air 35*x* stored adjacent to the face of a user 100 and ready to be inhaled in real-time. As the filtered air 35*x* from the first tube 15 is inhaled through the breathing mask 60, the filtered air 35*x* is continually replenished for approximately 8-12 hours without interruption, thus making the air purifier 10 a portable, practical, and unique solution for air filtration.

In interpreting the specification, all terms should be interpreted in the broadest possible manner consistent with the context. In particular, the terms "comprise", "comprises", "comprised", and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A portable air purifier comprising:

a collapsible first tube;

a firm second tube that houses the first tube, wherein the second tube comprises perforations;

a fan that brings air into a first end of the first tube and pushes the air through the first tube;

a multi-part filter arranged in a concentric configuration inside the first tube, wherein the multi-part filter is to filter the air as the air proceeds through the first tube;

an outlet at a second end of the first tube, wherein the outlet is to discharge filtered air from the first tube; and a breathing mask coupled to the outlet to receive the filtered air, wherein the perforations are sized to allow atmospheric pressure to transfer to the first tube, and wherein the first tube is adapted to be collapsible and expandable based on the atmospheric pressure being asserted thereon.

2. The portable air purifier of claim 1, wherein the first tube and the second tube are semi-circular to fit around a neck of a user.

3. The portable air purifier of claim 1, wherein the filter is a corrugated filter.

4. The portable air purifier of claim 1, comprising a power source electrically connected to the fan, wherein the power source is to power the fan.

5. The portable air purifier of claim 1, wherein the breathing mask comprises:

a first valve to discharge exhaled air of a user; and a second valve to prevent filtered air from returning to the first tube.

6. The portable air purifier of claim 5, wherein the first valve and the second valve comprise one-way valves.

7. The portable air purifier of claim 1, wherein the first tube comprises a UVC light that sterilizes the air brought into the first tube.

8. The portable air purifier of claim 1, wherein the first tube comprises a UVC light that sterilizes the filter.

9. The portable air purifier of claim 1, wherein the filter extends through a portion of the first tube.

10. The portable air purifier of claim 1, wherein the filter extends through approximately one-quarter of the length of the first tube.

11. The portable air purifier of claim 1, wherein the filter comprises a two-part filter.

12. A method for filtering air, the method comprising:

providing an air purifier comprising a collapsible first tube; a perforated firm second tube that houses the first tube; a fan adjacent to a first end of the first tube; a multi-part filter arranged in a concentric configuration inside the first tube; an outlet at a second end of the first tube; and a breathing mask coupled to the outlet;

pushing air via the fan into the first tube;

filtering the air via the filter as the air proceeds through the first tube;

discharging filtered air through the outlet; and transmitting the filtered air into a breathing mask, wherein perforations in the second tube are sized to allow atmospheric pressure to transfer to the first tube, and wherein the first tube is adapted to be collapsible and expandable based on the atmospheric pressure being asserted thereon.

13. The method of claim 12, further comprising:

arranging the air purifier around a neck of a user; and fitting the breathing mask over a mouth and nose of the user.

14. The method of claim 12, wherein the breathing mask comprises a first valve and a second valve, and wherein the method further comprises discharging exhaled air through the first valve.

15. The method of claim 14, further comprising preventing, via the second valve, filtered air that enters the breathing mask from returning back to the first tube and preventing exhaled air from reverse flowing into the first tube.

16. The method of claim 12, further comprising sterilizing the air brought into the first tube with a UVC light.

17. The method of claim 12, further comprising sterilizing the filter with a UVC light.

18. The method of claim 12, further comprising automatically adjusting a speed of the fan based on an action of a user, wherein the speed increases with inhalation of the filtered air, and wherein the speed decreases with exhalation of the filtered air.

* * * * *